US010878981B2

(12) United States Patent
Hidaka et al.

(10) Patent No.: US 10,878,981 B2
(45) Date of Patent: Dec. 29, 2020

(54) R-T-B BASED PERMANENT MAGNET

(71) Applicant: TDK CORPORATION, Tokyo (JP)

(72) Inventors: Tetsuya Hidaka, Tokyo (JP); Hidetake Kitaoka, Tokyo (JP); Eiji Kato, Tokyo (JP)

(73) Assignee: TDK CORPORATION, Tokyo (JP)

( * ) Notice: Subject to any disclaimer, the term of this patent is extended or adjusted under 35 U.S.C. 154(b) by 196 days.

(21) Appl. No.: 16/123,534

(22) Filed: Sep. 6, 2018

(65) Prior Publication Data

US 2019/0080827 A1 Mar. 14, 2019

(30) Foreign Application Priority Data

Sep. 8, 2017 (JP) ..... 2017-173481

(51) Int. Cl.
*H01F 1/057* (2006.01)
*H01F 7/02* (2006.01)

(52) U.S. Cl.
CPC ..... *H01F 1/0577* (2013.01); *H01F 7/02* (2013.01)

(58) Field of Classification Search
None
See application file for complete search history.

(56) References Cited

U.S. PATENT DOCUMENTS

2015/0235750 A1 8/2015 Miwa et al.
2017/0250015 A1* 8/2017 Miwa ..... C22C 38/001

FOREIGN PATENT DOCUMENTS

CN 104137197 A 11/2014
CN 107130183 A 9/2017
JP 2004-103659 A 4/2004

* cited by examiner

*Primary Examiner* — Xiaowei Su
(74) *Attorney, Agent, or Firm* — Oliff PLC

(57) ABSTRACT

Provided is an R-T-B based permanent magnet including main phase grains including an $R_2T_{14}B$ compound and a grain boundary. R is one or more rare earth elements essentially including Nd, T is Fe or Fe and Co and B is boron. the R-T-B based permanent magnet further includes X, Z and M. X is one or more selected from Ti, V, Zr, Nb, Hf and Ta, Z is one or more selected from C and N, M essentially includes Ga and further includes one or more selected from Al, Si, Ge, Cu, Bi and Sn. The grain boundary includes an XZ phase having a face-centered cubic structure.

12 Claims, 7 Drawing Sheets

R-T-B BASED PERMANENT MAGNET

TECHNICAL FIELD

The present invention relates to an R-T-B based permanent magnet.

BACKGROUND

As a permanent magnet in a motor, rare earth sintered magnets are actively used due to their high magnetic properties, particularly to the high coercive force. In particular, R-T-B based sintered magnets are actively used.

Further improvement is required for R-T-B based sintered magnets due to demands accompanying high performance of motors. For example, improvement of a residual magnetic flux density Br, improvement of a coercive force HcJ, improvement of a strength, improvement of a corrosion resistance, and improvement in a high electric resistance for suppressing eddy currents are required. Among them, expectation for improving HcJ is great since the magnets can be used at a high temperature.

For example, as a technique for increasing HcJ of the R-T-B based sintered magnet at room temperature, methods are known wherein R(Nd) is partly substituted with heavy rare earth elements such as Dy or Tb in an $R_2Fe_{14}B$ compound which is a crystal grain (hereinafter also referred to as a main phase grain) constituting the main phase. By substituting a part of Nd with Dy or Tb, the magneto crystalline anisotropy of the $R_2Fe_{14}B$ compound is increased, and as a result, HcJ of the Nd—Fe—B based sintered magnet can be sufficiently increased. For example, Patent Document 1 describes an invention of increasing HcJ by substituting a part of Nd in $Nd_2Fe_{14}B$ compound with Dy or Tb.

Patent Document 1: JP 2004-103659 A

SUMMARY

In order to obtain R-T-B based sintered magnet that meets a wide variety of demands, it is important that HcJ can be further increased by a method other than substituting a part of R(Nd) with heavy rare earth elements such as Dy or Tb. The inventors have found that in order to further improve HcJ, it is important not only to optimize the composition, grain diameter, etc. of the $R_2T_{14}B$ compound which is the main phase grain but also to optimize a grain boundary phase existing in the grain boundary. Then, the present inventors conducted various studies focusing on the kind of grain boundary phase present in the grain boundary, the area ratio of various grain boundary phases, and the like. As a result, in the case of including a specific kind of the grain boundary phase, the R-T-B based permanent magnet excellent in Br, HcJ, strength, grain boundary phase electric resistance, or sintering stability was found.

The present invention has been made in consideration of such circumstances, and it is an object of the invention to provide an R-T-B based permanent magnet in which Br and HcJ are further improved, and is excellent in strength, grain boundary phase electric resistance, or sintering stability.

An R-T-B based permanent magnet including main phase grains including an $R_2T_{14}B$ compound and a grain boundary, in which R is one or more rare earth elements essentially including Nd, T is Fe or Fe and Co and B is boron, the R-T-B based permanent magnet further includes X, Z and M, X is one or more selected from Ti, V, Zr, Nb, Hf and Ta, Z is one or more selected from C and N, M essentially includes Ga and further includes one or more selected from Al, Si, Ge, Cu, Bi and Sn, and the grain boundary includes an XZ phase having a face-centered cubic structure.

The R-T-B based permanent magnet of the invention, by having the above properties, realizes further improvement of HcJ and Br, and obtains good strength, the grain boundary phase electric resistance or the sintering stability.

The R-T-B based permanent magnet of the invention, in which

R content may be 13.3 at % or more and 15.5 at % or less,

M content may be 0.5 at % or more and 5.0 at % or less,

B content may be 4.0 at % or more and 5.5 at % or less,

X content may be 0.05 at % or more and 0.5 at % or less, and

T may be a substantial balance, with respect to 100 at % of the total contents of the respective elements of R, T, B, M and X, and the R-T-B based permanent magnet further may satisfy all the following expressions:

$$4.5<T/R<7.0,$$

$$14<T/B<18 \text{ and}$$

$$2.5<R/B<3.0.$$

The R-T-B based permanent magnet of the invention, in which the maximum area of the XZ phase may be 16 $\mu m^2$ or less.

The R-T-B based permanent magnet of the invention, in which the maximum area of the XZ phase may be 12 $\mu m^2$ or less.

The R-T-B based permanent magnet of the invention, in which an existence ratio of Zr included in the XZ phase may be 50 at % or more with the X being 100 at %, and an existence ratio of C included in the XZ phase may be 50 at % or more with the Z being 100 at %.

The R-T-B based permanent magnet of the invention, in which an area ratio of the XZ phase in a region of a cross-sectional area of the R-T-B based sintered magnet may be 0.1 to 2%.

The R-T-B based permanent magnet of the invention, in which the grain boundary may include a crystal phase having a $La_6Co_{11}Ga_3$ type crystal structure.

The R-T-B based permanent magnet of the invention, in which the crystal phase may include R, M, B and X, and in the crystal phase, R content may be 27.0 at % or more and 32.0 at % or less, M content may be 3.0 at % or more and 8.0 at % or less, B content may be zero at % or more and 0.40 at % or less, and X content may be zero at % or more and 0.45 at % or less.

The R-T-B based permanent magnet of the invention, in which the grain boundary may include an R-O-C-N phase.

The R-T-B based permanent magnet of the invention, in which the grain boundary may include a body-centered cubic lattice phase.

The R-T-B based permanent magnet of the invention, in which the grain boundary may include a crystal phase having a $La_6Co_{11}Ga_3$ type crystal structure, an R-rich phase, an R-O-C-N phase and a body-centered cubic lattice phase, and may satisfy the following expressions:

$S1>S2$, $S1>S3$, $S1>S4$ and, $S1>S5$ when an area of the crystal phase in a cross-sectional area of the R-T-B based permanent magnet is S1, an area of the R-rich phase is S2, an area of the R-O-C-N phase is S3, an area of the body-centered cubic lattice is S4, and an area of the XZ phase is S5.

DETAILED DESCRIPTION

Hereinafter, an embodiment of the invention will be described with reference to the drawings. It should be noted that the present invention is not limited thereto.

The R-T-B based permanent magnet of the embodiment includes a main phase grain including the $R_2T_{14}B$ compound and a grain boundary existing between a plurality of the main phase grains.

R is one or more rare earth elements. R may be one or more rare earth elements essentially including Nd. In addition, in consideration of cost reduction and high Br, it is preferable that substantially no heavy rare earth element is included as R. The substantial absence of the heavy rare earth elements as R means that the heavy rare earth element content relative to the entire R is 1 at % or less. T is Fe or Fe and Co. B is boron.

Figure 1A:
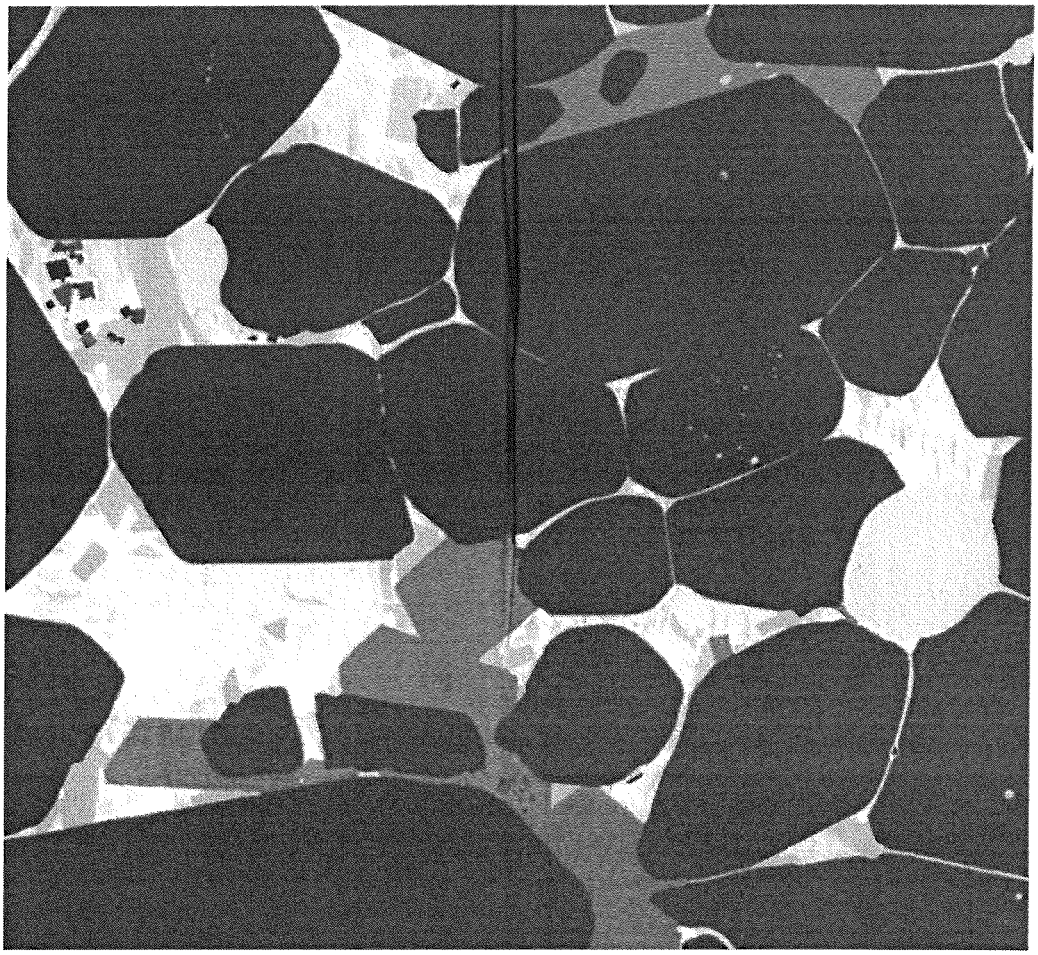
FIG. 1A is a SEM image of one cross section of the R-T-B based permanent magnet of Example 1.

By observing the cross section of the R-T-B based permanent magnet of the embodiment with a backscattered electron image of the SEM (hereinafter sometimes simply referred to as SEM image), for example, as shown in FIG. 1A, the main phase grain and plural kinds of the grain boundary phase present in the grain boundary can be seen. The plural kinds of the grain boundary phase each has a shade of color corresponding to the composition and a shape corresponding to the crystal system.

By point analyzing each grain boundary phase using EPMA and clarifying the composition, the grain boundary phase thereof can be identified.

Figure 1B:
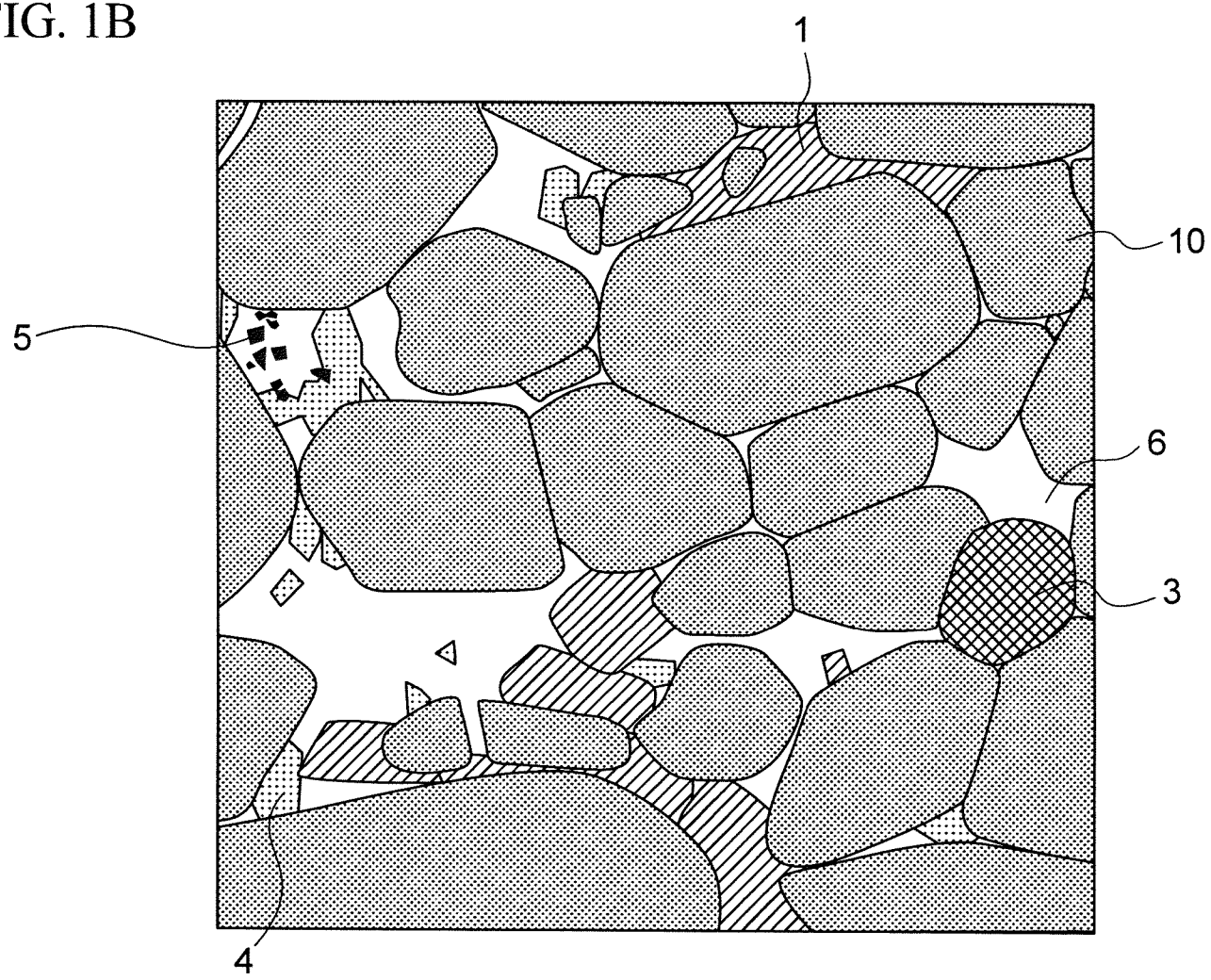
FIG. 1B is a schematic diagram of FIG. 1A.

Furthermore, by confirming the crystal structure of each grain boundary phase by TEM, the grain boundary phase can be clearly identified. For example, FIG. 1B shows a schematic diagram for identifying each grain boundary phase of the SEM image shown in FIG. 1A.

The R-T-B based permanent magnet of the embodiment includes the main phase grains 10 and the grain boundary, and the grain boundary includes an XZ phase 5. The XZ phase 5 is the crystal phase having a face-centered cubic structure. By including the XZ phase 5 in the grain boundary, it is possible to improve HcJ without decreasing Br. Further, the strength, the electrical resistance of the grain boundary phase, or the sintering stability can be improved.

In FIG. 1A, the XZ phase 5 is observed as a dark black part and is a small polygon whose shape is very small. Since the area is smaller than the other grain boundary phases described later, composition analysis of the XZ phase 5 is preferably performed by TEM. The maximum area of the XZ phase 5 is preferably 16 $\mu m^2$ or less, and more preferably 12 $\mu m^2$ or less. Here, "the maximum area" refers to the area of the largest size among the XZ phases confirmed in the SEM image in which one polished cross section of each sample is observed. In this case, at least 20 XZ phases in plural fields of view are observed and the sizes thereof are compared. For example, in FIGS. 2 and 3 in which SEM observation is performed on the R-T-B based permanent magnet within the range of the embodiment but different from the one in FIG. 1A, the maximum area of the XZ phase 5 is about 1 $\mu m^2$.

The XZ phase 5 is a crystal phase having a face-centered cubic lattice (NaCl structure). Specifically, X is one or more selected from Ti, V, Zr, Nb, Hf, or Ta. Further, X is preferably one or more selected from Zr, Ti or Nb, and more preferably Zr. The use of Zr as X is preferred relative to the use of Ti or Nb, due to the small decrease in Br with respect to the added amount. Z is C, N, or C and N, and preferably C. The XZ phase 5 is made of such as ZrC, TiC, ZrN, etc. It is preferable that the existence ratio of Zr included in the XZ phase 5 is 50 at % or more with the entire X being 100 at %. And the existence ratio of C included in the entire XZ phase is 50 at % or more with the entire Z being 100 at %.

The mechanism by which the HcJ of the R-T-B based permanent magnet improves when the XZ phase 5 exists in the grain boundary is not clear. In the case where the XZ phase 5 is present in the grain boundary, C and/or N are mainly captured in grain boundaries as a compound. Thus, it is considered that lowering of the HcJ due to inclusion of C and/or N in the main phase grains is suppressed and the HcJ is improved. Further, by making the XZ phase 5 exist in the grain boundary, it is considered that it is possible to increase the electric resistance at the grain boundary and suppress the influence of the eddy current. Further, it is considered that the XZ phase 5 has an effect of suppressing the grain growth of the main phase grains 10 when sintering. It is also considered that the HcJ of the R-T-B based permanent magnet is also improved by suppressing the grain growth of the main phase grain 10.

The average grain diameter of the main phase grain 10 is preferably 1 μm or more and 10 μm or less. The HcJ is improved particularly by controlling the diameter to 5 μm or less. By controlling to 2 μm or more, the pulverization time in the producing process described below can be shortened. Accordingly, productivity can be improved. The average grain diameter of the main phase grain 10 is preferably 2 μm or more and 5 μm or less.

There is no particular limitation on the area ratio of the XZ phase 5 (hereinafter may be referred to as S5) in a polished cross section of the R-T-B based permanent magnet of the embodiment, but it is preferably 0.01% or more and 2% or less, and more preferably 0.1% or more and 2% or less. When the content is 0.1% or more, the above effect is easily exerted. When the content is 2% or less, the area ratio of the main phase grain 10 can be sufficiently secured and Br can be kept high. S5 is more preferably 0.2% or more and 1% or less. It is considered that the XZ phase 5 is not included when S5 is less than 0.01%.

Figure 4A:
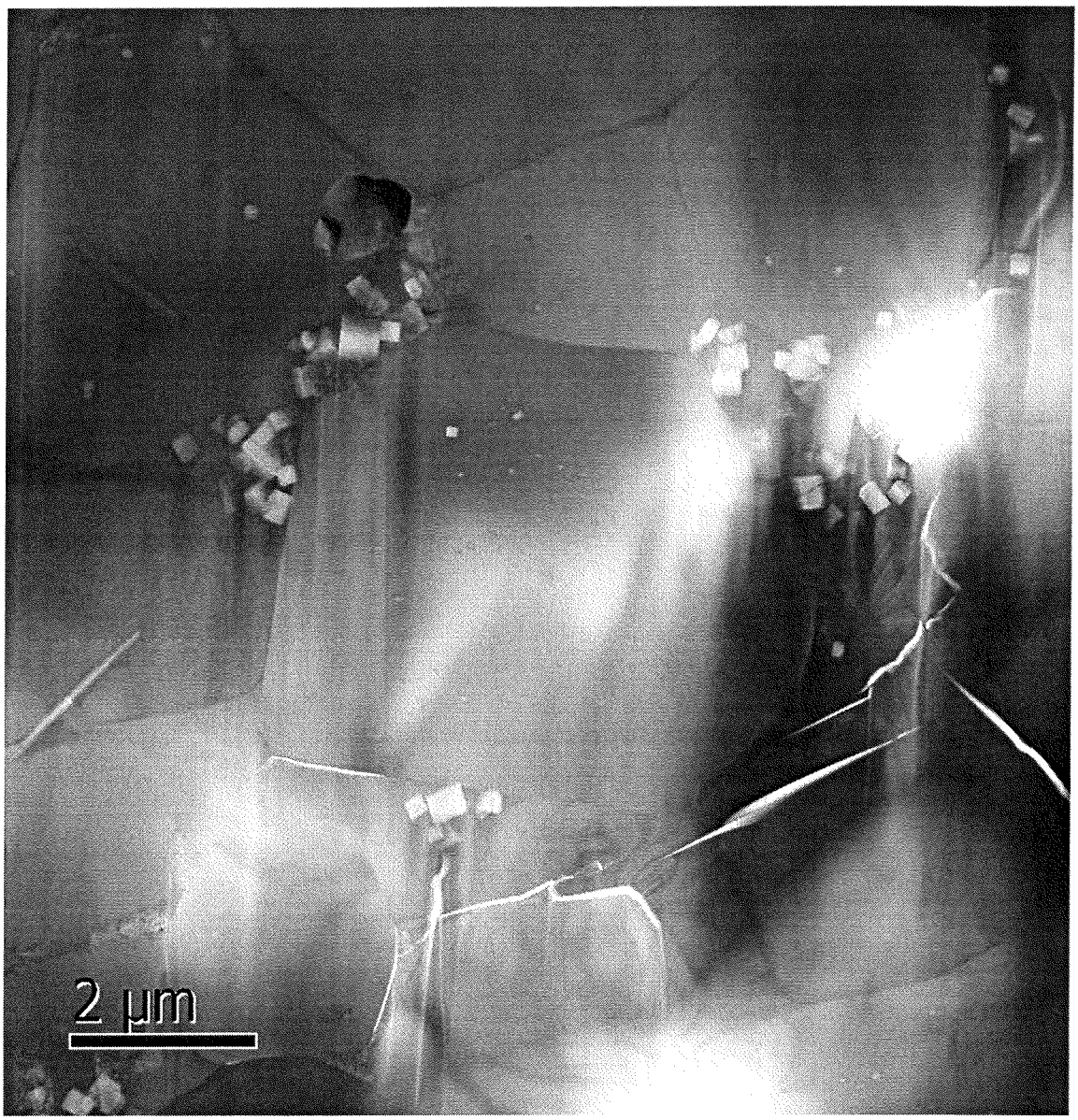
FIG. 4A is a TEM image of one cross section of the R-T-B based permanent magnet of Example 1.
Figure 4B:
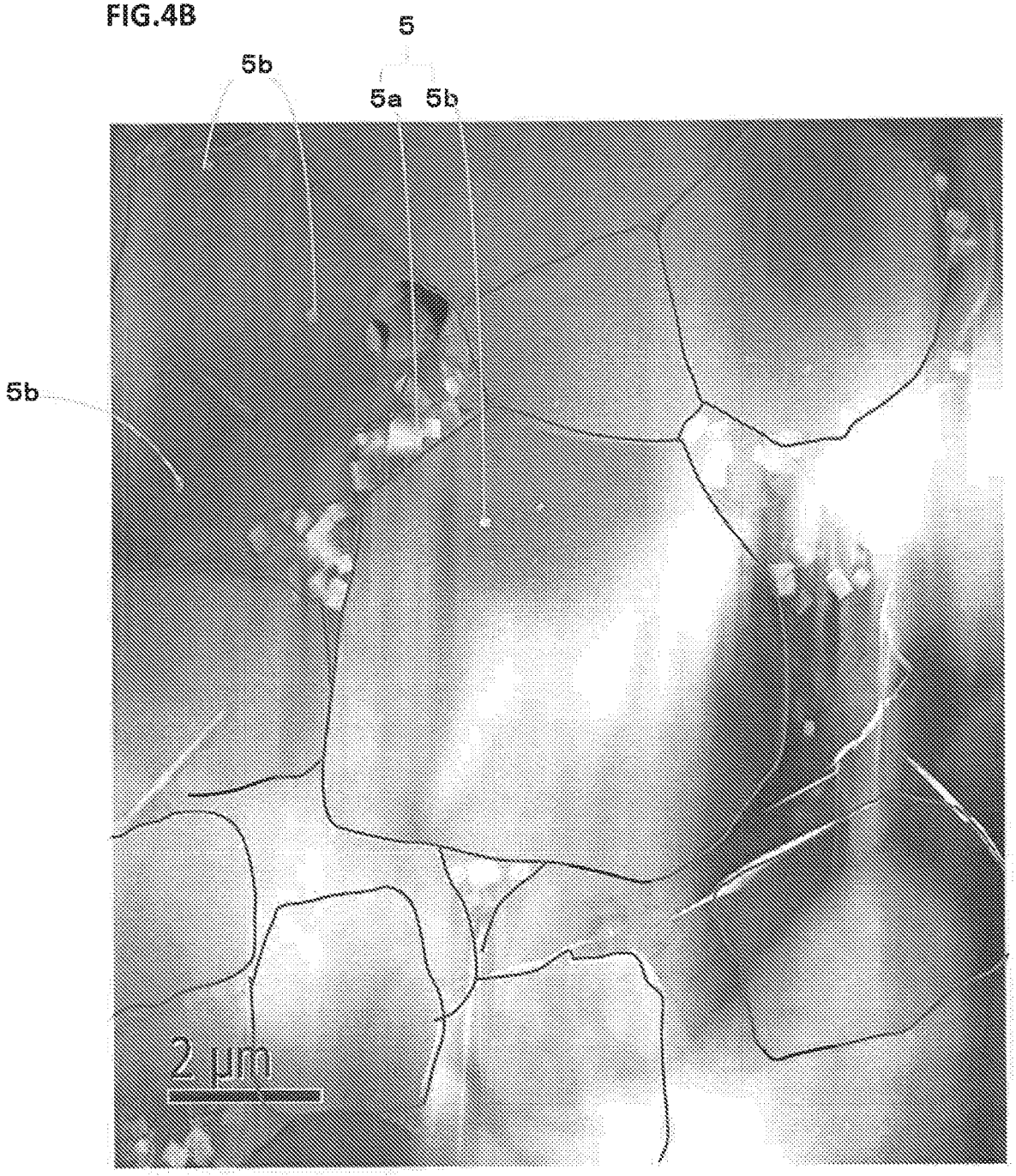
FIG. 4B is a TEM image clarifying the boundary between the main phase grains and grain boundaries.

Further, the XZ phase 5 exists not only in the grain boundary but also in the main phase grain 10 with an extremely fine size. For example, FIG. 4A shows an image obtained by TEM observation of a part different from that in FIG. 1. Further, FIG. 4B is a diagram in which the boundary between the main phase grain and the grain boundary in FIG. 4A is clarified. As shown in FIG. 4A, in addition to the XZ phase 5*a* in the grain boundary, the XZ phase 5*b* also exists in the main phase grain 10.

The R-T-B based permanent magnet of the embodiment may further include the crystal phase (hereinafter sometimes simply referred to as a crystal structure phase) having a $La_6Co_{11}Ga_3$ type crystal structure in the grain boundary. It is illustrated as the crystal structure phase 1 in FIG. 1B. Thereby, the HcJ can be improved, and the electric resistance, the corrosion resistance and a bending strength can be improved.

Note that the crystal structure phase 1 is a dark gray part in FIG. 1A. It can be confirmed using such as TEM that the crystal structure of the crystal structure phase 1 is $La_6Co_{11}Ga_3$ type.

The composition of the crystal structure phase 1 is not particularly limited. For example, it is an R-T-M based composition including R, T and M. M essentially includes Ga and is one or more selected from Al, Si, Ge, Cu, Bi and Sn. By making Ga essential, the HcJ tends to be improved.

As shown in FIGS. 1A and 1B, the grain boundary of the embodiment may include, in addition to the XZ phase 5 and the crystal structure phase 1, for example an R-rich phase 6, an R-O-C-N phase 3, a body-centered cubic lattice phase 4, etc.

R-O-C-N phase 3 is a compound phase having a composition ratio in which R/(O+C+N) is about one in atomic ratio, and the composition ratio of O, C and N are non-stoichiometric.

The R-O-C-N phase 3 and the grain boundary phase such as the R-rich phase 6 do not show a large difference in the black and white density in FIG. 1A. The R-O-C-N phase 3 has a characteristic shape of a substantially circular shape or a substantially elliptical shape.

The body-centered cubic lattice phase 4 is a grain boundary phase in which the crystal structure lattice is a body-centered cubic lattice. Specifically, it mainly includes R-T-M based compounds. The constituent elements of the body-centered cubic lattice phase 4 are similar to that of the crystal structure phase 1, but their crystal structures are different. The body-centered cubic lattice phase 4 includes 10 at % or more and 50 at % or less of T, and includes at least R, T and M.

In FIG. 1A, the black and white density of the body-centered cubic lattice phase 4 is an intermediate between those of the R-rich phase 6 and the crystal phase 1 having the $La_6Co_{11}Ga_3$ type crystal structure. It can be confirmed using such as TEM that the fact that the crystal structure of the body-centered cubic lattice phase 4 is a body-centered cubic lattice.

The R-rich phase 6 is a grain boundary phase in which the R content is 50 at % or more.

Here, SEM observation is performed to 10 or more different fields of view (the number of the main phase grains in the total observation fields of view is 200 or more) of the R-T-B based permanent magnet of the embodiment, and the area of each grain boundary phase is calculated. The ratio of the total area of each grain boundary phase, when the main phase grains and grain boundaries in the total fields of view is 100%, is referred to as an area ratio. The area ratio of the crystal phase (crystal structure phase) having the $La_6Co_{11}Ga_3$ type crystal structure is S1(%), the area ratio of the R rich phase is S2(%), the area ratio of the R-O-C-N phase is S3(%), the area ratio of the body-centered cubic lattice phase is S4(%), and the area ratio of the XZ phase is S5(%). Their relationships may be S1>S2, S1>S3, S1>S4 and S1>S5. The area ratio S1 of the crystal structure phase 1 is relatively large, so that the effect of the invention is further enhanced.

Hereinafter, measurement conditions by SEM and EPMA will be described in more detail.

The magnification and the field of view are set so that approximately 200 main phase grains can be observed in the polished cross section of the observation target, and a photographing is performed. The magnification and the field of view can be appropriately decided according to the size and dispersion state of each grain boundary phase. The polished cross section may be parallel to the orientation axis of the main phase grain, orthogonal to the orientation axis, or may be at any angle with the orientation axis. This cross section is observed using SEM-EDS and EPMA. This clarifies the distribution state of each element and clarifies the distribution state of the main phase grain and each grain boundary phase. Furthermore, each kind of the grain boundary phases included in the field of view subjected to the surface analysis are subjected to a point analysis with EPMA to determine the composition of each grain boundary phase. For example, when determining the composition of the crystal structure phase 1, the composition of at least 5, preferably 10 or more crystal structure phases 1 are measured and averaged.

The R-T-B based permanent magnet of the embodiment preferably satisfies the followings:

R content is 13.3 at % or more and 15.5 at % or less,

M content is 0.5 at % or more and 5.0 at % or less,

B content is 4.0 at % or more and 5.5 at % or less,

X content is 0.05 at % or more and 0.5 at % or less, and

T is a substantial balance, with respect to 100 at % of the total contents of the respective elements of R, T, B, M and X.

The R-T-B based permanent magnet further satisfies all the following expressions:

$$4.5<T/R<7.0,$$

$$14<T/B<18 \text{ and}$$

$$2.5<R/B<3.0.$$

The R-T-B based permanent magnet according to the embodiment preferably has the above composition in order to facilitate generation of the crystal structure phase 1 in the grain boundary phase.

The composition of the R-T-B based permanent magnet may be out of the above range. When the composition of the R-T-B based permanent magnet is the same and the grain boundary phase includes the XZ phase 5, HcJ improves as compared with the case in which the grain boundary phase does not include the XZ phase 5.

"T is substantially the balance" means that in the R-T-B based permanent magnet, the ratio of elements other than R, B, M, T and X with respect to the total atomic weight excluding O, C and N is 1 at % or less. In addition, the elements other than R, B, M, X, and T described above are mainly inevitable impurities due to the raw material or the producing step. The inevitable impurities include such as Ca, Mn, P, S, etc.

The R content is preferably 13.3 at % or more and 15.5 at % or less. R is an element indispensable for formation of the $R_2T_{14}B$ compound which is the main phase grain. If the R content is less than 13.3 at %, HcJ and/or a squareness ratio Hk/HcJ may decrease. If the R content exceeds 15.5 at %, Br may decrease. The R content is preferably 13.3 at % or more and 15.0 at % or less.

The M content is preferably 0.5 at % or more and 5.0 at % or less. If M content is less than 0.5 at %, HcJ may decrease. If the M content is more than 5.0 at %, Br may decrease. The M content is preferably 0.5 at % or more and 3.0 at % or less. The Ga content is preferably 0.19 at % or more and 2.50 at % or less.

The B content is preferably 4.5 at % or more and 5.5 at % or less. B is an element indispensable for formation of the $R_2T_{14}B$ compound constituting the main phase grains. If the B content is less than 4.5 at %, HcJ may decrease. If the B content exceeds 5.5 at %, HcJ may decrease. Especially when the B content is too large, X is more likely to bond to B than Z, and the XB phase is easily formed. Thus, it becomes difficult for the XZ phase to generate in the grain boundary phase.

It is preferable to satisfy $4.5<T/R<7.0$ and $14<T/B<18$. If T/R and/or T/B do not satisfy the above numerical range, HcJ and/or the bending strength may decrease.

Further, it is preferable to satisfy $2.5<R/B<3.0$. If R/B does not satisfy the above numerical range, the corrosion resistance may decrease. In addition, the sintering stability may decrease.

In the embodiment, it is preferable that no phase (for example, a $ZrB_2$ phase) including X and B as main elements is substantially present in the grain boundary phase. It is preferable that the area ratio of the phase including X and B as the main elements in the grain boundary phase with respect to the entire cross section of the R-T-B based permanent magnet is 0.5% or less.

The X content is preferably 0.05 at % or more and 0.5 at % or less. If the X content is less than 0.05 at %, HcJ may decrease. When the X content exceeds 0.5 at %, Br may decrease. The X content is preferably 0.05 at % or more and 0.4 at % or less.

T may be Fe alone, or Fe and Co may be included. From the viewpoint of improving HcJ of the R-T-B based permanent magnet, it is particularly preferable to set the Co content to zero at %, that is, not to include Co. From the viewpoint of improving the corrosion resistance of the R-T-B based permanent magnet, the Co content is preferably 0.50 at % or more and 3.5 at % or less, more preferably 1.0 at % or more and 3.0 at % or less. The R-T-B based permanent magnet tends to show a lower HcJ while tends to show an improvement in the corrosion resistance, when increasing the Co content. Even if the Co content is larger than 3.5 at %, the corrosion resistance does not change as much as compared with the case where the Co content is 3.5 at %, but the cost increases.

The O, C and N contents in the rare earth permanent magnet of the embodiment are not particularly limited.

According to the R-T-B based permanent magnet of the embodiment, there is no particular limitation on the composition of the crystal structure phase 1 included in the grain boundary, as long as it is within the range of maintaining the $La_6Co_{11}Ga_3$ type crystal structure. For example, the content of each element relative to the total atomic weight included in the crystal structure phase 1 may be as follows.

R: 27.0 at % or more and 32.0 at % or less

M: 3.0 at % or more and 8.0 at % or less

B: zero at % or more and 0.40 at % or less

X: zero at % or more and 0.45 at % or less

Among the above elements, B and X contents are preferably as small as possible in the crystal structure phase 1, and may not be included in the crystal structure phase 1.

In addition, the element other than R, M, B and X included in the crystal structure phase 1 is substantially only T in general. That is, T is a substantial balance in the crystal structure phase 1. The fact that the T content is a substantial balance means that the ratio of elements other than R, M, B, X and T with respect to the total atomic weight included in the crystal structure phase 1 is 2 at % or less.

The Al content with respect to the Ga content (Al/Ga) in the crystal structure phase 1 is preferably 0.35 or less in atomic ratio. If Al/Ga exceeds 0.35, the corrosion resistance may decrease. In addition, the electric resistance in the crystal structure phase tends to be lower than the same in the main phase grains. Further, the Cu content with respect to the Ga content (Cu/Ga) in the crystal structure phase 1 is preferably 0.09 or less in atomic ratio. If Cu/Ga is less than 0.09, the corrosion resistance may decrease.

Further, when the Pr content with respect to the Nd content in the whole magnet is A1 (=Pr/Nd) in terms of atomic ratio, the Co content with respect to the Fe content in the whole magnet is A2 (=Co/Fe) in terms of atomic ratio, Pr content with respect to the Nd content in the crystal structure phase 1 is B1 (=Pr/Nd) in terms of of atomic ratio, the Co content with respect to the Fe content in the crystal structure phase 1 is B2 (=Co/Fe) in terms of atomic ratio, it is preferably $0.85<B1/A1<1.25$. When B1/A1 is 1.25 or more, corrosion resistance may decrease. It is also preferable that $B2/A2>0.9$. If B2/A2 is 0.9 or less, the corrosion resistance may decrease.

Hereinafter, an example of a producing method of the R-T-B based permanent magnet of the embodiment will be described. The producing method of the R-T-B based permanent magnet of the embodiment is not specified by the following production method, the object of the present invention can be easily achieved by using the following producing method.

The R-T-B based permanent magnet of the embodiment can be produced by a usual powder metallurgy method. The powder metallurgy method includes a preparation step of preparing a raw material alloy, a pulverization step of pulverizing the raw material alloy to obtain raw material fine powder, a pressing step of pressing the raw material fine powder to form a green compact, a sintering step of sintering the green compact and obtain the sintered body, and a heat treatment step of applying an aging treatment to the sintered body.

The preparation step is a step of preparing the raw material alloy having each element included in the rare earth magnet of the embodiment. First, a raw material metal having a predetermined element is prepared. A raw material alloy can be prepared by melting and solidifying thereof by such as a strip casting method. Examples of the raw material metals are rare earth metals, rare earth alloys, pure iron, pure cobalt, ferroboron, and alloys thereof. Using these raw material metals, raw material alloys are prepared to obtain rare earth magnets having a desired composition.

In addition, heat treatment (homogenization treatment) may be applied to the raw material alloy for the purpose of homogenizing the structure and the composition. C included in the whole raw material alloy is 500 ppm or less, and preferably 300 ppm or less. If the C content in the raw material alloy is too large, the HcJ of the finally obtained R-T-B based permanent magnet decreases. If the C content included in the raw material alloy is too small, the raw material alloy becomes expensive.

Due to this homogenizing treatment, X (such as Zr) included in the main phase grains may be discharged outside the main phase grain (grain boundary). X and Z (such as C and/or N) bond each other between the subsequent pulverization step and heat treatment step to form the XZ phase. Also, X and B tend to be preferentially bonded when B content is large. Thus, X and Z become difficult to bond.

The pulverization step is a step of pulverizing the raw material alloy obtained from the preparation step to obtain the raw material powder. This step is preferably carried out in two stages of the coarse pulverization step and the fine pulverization step, but the step may be in one stage. The coarse pulverization step can be carried out in an inert gas atmosphere using such as a stamp mill, a jaw crusher, a brown mill, etc. Hydrogen storage pulverization, in which pulverization can be carried out after hydrogen is stored, can be carried out. In the coarse pulverization step, pulverization is carried out until the grain diameter of the raw material alloy becomes several hundred μm to several mm.

The fine pulverization step is a step in which a pulverization aid is added to the powder obtained from the coarse pulverization step, mixed and pulverized thereof to prepare raw material powder having an average grain diameter of about several micrometers. The average grain diameter of the raw material powder may be set in consideration of the grain diameter after sintering. The fine pulverization can be carried out using such as a jet mill. The type of the pulverization aid is not particularly limited, but such as oleic acid amide, lauric acid amide, etc. can be used.

The pressing step is a step of forming the green compact by pressing the raw material powder in the magnetic field. Specifically, after filling the raw material powder in a press mold disposed in the electromagnet, pressing is carried out by pressurizing the raw material powder while applying the magnetic field with the electromagnet and orienting the crystal axis of the raw material powder. According to the above pressing in the magnetic field, for example a magnetic field of 1000 kA/m or more and 1600 kA/m or less is applied and pressurized at a pressure of approximately 30 MPa or more and 300 MPa or less.

The sintering step is a step of sintering the green compact to obtain a sintered body. After pressing in the magnetic field, the green compact can be sintered in a vacuum or an inert gas atmosphere to obtain a sintered body. The sintering conditions can be appropriately set according to the conditions such as the composition of the green compact, the pulverization method of the raw material powder, the grain diameter, etc. For example, the sintering temperature may be set to 1000° C. or more and 1100° C. or less, and the sintering time may be set to 1 hour or more and 36 hours or less.

In addition, the shorter the treating time of the alloy homogenizing treatment is and the shorter the sintering time of the sintering step is, the smaller the maximum area of the XZ phase tends to be. Also, the larger the X content is, the larger the maximum area of the XZ phase tends to become.

The smaller the maximum area of the XZ phase is, the better the sintering stability is. Thus, Br and the bending strength tend to be improved. The reason is considered to be that dispersion in the magnet becomes worse as the XZ phase becomes larger, and grain growth suppression effect by the XZ phase becomes lower. In addition, it is considered that the coarse XZ phase inhibits the orientation of the main phase grains during sintering and reduces Br of the R-T-B based permanent magnet. Further, it is considered that the bending strength of the R-T-B based permanent magnet is lowered due to deterioration of dispersion of the XZ phase in the R-T-B based permanent magnet.

Further, the compound XZ which is an origin of the XZ phase included in the finally obtained R-T-B based permanent magnet may be separately added in the pulverization step.

The heat treatment step is a step of applying an aging treatment to the sintered body. By this step, area ratio and composition of each grain boundary phase, particularly the crystal structure phase is finally determined. However, the area ratio and the composition of each grain boundary phase are not controlled only by the heat treatment step, but are controlled by a balance with various conditions of the above sintering step and the state of the raw material fine powder. Therefore, the heat treatment temperature (aging treatment temperature) and the heat treatment time (aging treatment time) may be set, taking into consideration the relationship between the heat treatment condition and the structure of the grain boundary phase. The heat treatment may be carried out in a temperature range of 500° C. to 900° C. The heat treatment may be divided into two stages including a heat treatment at 700° C. or more to 900° C. or less (a first aging treatment) and then, a heat treatment at 450° C. or more to 600° C. or less (a second aging treatment).

Although the cooling rate after the second aging treatment is not particularly limited, it is preferably 80° C./min or less, more preferably 40° C./min or less, and the most preferably 10° C./min or less. By lowering the cooling rate after the second aging treatment, the generation amount of the crystal structure phase is increased and the HcJ is improved.

The R-T-B based permanent magnet (the R-T-B based sintered magnet) of the embodiment can be obtained by the above method, but a producing method of the R-T-B based permanent magnet is not limited thereto and can be suitably changed.

The O, C and N contents in the rare earth permanent magnet of the embodiment can be controlled by the producing conditions. The O content can be controlled by changing the oxygen concentration. For example, when the pulverization step to the sintering step are carried out in a low oxygen atmosphere of 100 ppm or less, O included in the rare earth permanent magnet can be less than 1000 ppm. In addition, when it is carried out in an oxygen atmosphere of 1000 ppm to 10000 ppm, O included in the rare earth permanent magnet is about 2000 ppm to 5000 ppm.

The C content depends on such as the content amount in the raw material metal, the type and amount of the organic substance to be added as an additive agent during pulverization and/or pressing. In the embodiment, it is preferable to control the C content to such as approximately 150 ppm to 1500 ppm.

For example, when a jet mill is used for the fine grinding step, the N content can be controlled by changing the amount, the concentration, the fine grinding time, etc. of the $N_2$ gas flow to be used. In the embodiment, it is preferable to control the N content to approximately 100 ppm to 700 ppm.

Further, the R-T-B based permanent magnet of the embodiment is not limited to the R-T-B based sintered magnet produced by the sintering as described above. For example, it may be an R-T-B based permanent magnet produced by a hot molding and a hot working instead of the sintering.

When the hot molding is carried out to pressurize a cold green body obtained by pressing the raw material powder at room temperature while heating, the pores remaining in the cold green body disappear, and the green body can be densified without being sintered. Further, by subjecting the green body obtained by the hot molding to a hot extrusion processing as the hot processing, an R-T-B based permanent magnet having a desired shape and a magnetic anisotropy can be obtained.

EXAMPLES

Next, the present invention will be described in more detail based on the specific examples, but the invention is not limited thereto.

(Experiment 1)

Raw material metals were prepared so that the composition of the R-T-B based sintered magnet would be the composition of each sample shown in Table 1. The raw material alloys were prepared by carrying out a strip casting method using the raw material metals. Among the content of each element shown in Table 1, R, T, X and M were measured by an X-ray fluorescence analysis and B was measured by an ICP emission analysis.

The prepared raw material alloy was subjected to the homogenizing treatment under Ar atmosphere at the treatment temperature and treatment time shown in Table 2. In Comparative Example 1, no homogenizing treatment was carried out.

Next, the raw material alloy was subjected to a hydrogen pulverization treatment to obtain alloy coarse powder. The hydrogen pulverization treatment was carried out in order of the followings: hydrogen was stored in the raw material alloy, dehydrogenation was carried out at 600° C. for 1 hour in an Ar atmosphere, and cooled thereof to a room temperature under Ar atmosphere.

0.10 wt % of oleic acid amide as the pulverization aid was added to the obtained alloy coarse powder, mixed thereof, and then the fine pulverization was carried out using a jet mill. The average grain diameter: D50 of the obtained raw material powder was 3.9 μm or more and 4.1 μm or less.

The obtained raw material powder was filled in the press mold. Thereafter, in a low oxygen atmosphere, pressing was performed under the conditions of an orientation magnetic field of 1200 kA/m and a pressing pressure of 50 MPa to obtain a green compact.

Thereafter, the green compact was sintered in the vacuum and then quenched to obtain a sintered body. A two-stage heat treatment (aging treatment) was performed on the obtained sintered body. The sintering temperature was 1030° C. or more and 1090° C. or less, the sintering time was 4 hours or more and 36 hours or less, the first aging temperature was 800° C. or more and 900° C. or less, the first aging time was 1 hour or more and 2 hours or less, the second aging temperature was 51° C. or more and 550° C. or less, and the second aging time was 1 hour or more and 2 hours or less. Specific conditions are shown in Table 2.

According to the R-T-B based sintered magnet of each sample obtained by the above method, Br and HcJ were respectively measured using a B-H tracer. In addition, according to the composition of the entire R-T-B based sintered magnet of each sample, R, T, Zr and M were measured by an X-ray fluorescence analysis and B was measured by an ICP emission analysis. Table 1 shows the composition and Table 2 shows the magnetic properties.

For each Example and Comparative Example, the temperature range (the sintering temperature range) in which high density and high magnetic properties can be maintained without causing abnormal grain growth was evaluated. Specifically, in a temperature range of 1030° C. or more and 1090° C. or less, a fracture surface of a magnet sample treated at a plurality of sintering temperatures set at intervals of 5° C. was observed by SEM. And the presence or absence of abnormal grains having a grain diameter of 10 times or more the average grain diameter were confirmed. It was assumed that high density and high magnetic properties could be maintained without causing the abnormal grain growth at a temperature in which a number ratio of the abnormal grains is 0.5 grains/cm$^2$ or less. A temperature range in which the number ratio of the abnormal grains is 0.5 grains/cm$^2$ or less was set as a sintering temperature range. The size of the sintering temperature range is preferably 20° C. or more and more preferably 30° C. or more considering mass production.

Further, with respect to each sample, the polished cross section was observed by SEM and EPMA to identify each grain boundary phase included in the grain boundary and the area ratio of each grain boundary phase in the polished cross section was calculated. Specifically, it was classified into a plurality of the grain boundary phases from the shading in the backscattered electron image of SEM. Then, by comparing each classified grain boundary phase with the composition obtained from the result of EPMA mapping, each grain boundary phase was identified. Then, the area ratio of each grain boundary phase was calculated. In the Example, ten SEM images of different parts of the polished cross sections were observed. The area ratio of each grain boundary phase was calculated by averaging the area ratio of each grain boundary phase in each observed SEM image.

For example, FIG. 1A is one of the SEM images of Example 1. FIG. 1B is a schematic diagram in which the main phase grains and each grain boundary phase in the SEM image are specified.

Then, the area ratio of the crystal structure phase 1 is defined as S1(%), the area ratio of the R-rich phase 6 as S2(%), the area ratio of the R-O-C-N phase 3 as S3(%), the area ratio of the body-centered cubic lattice phase 4 as S4(%), and the area ratio of the XZ phase 5 as S5(%). In this example, ten SEM images of different parts of the polished cross section were observed. The area ratio of each grain boundary phase was calculated by averaging the area ratio of each grain boundary phase in each observed SEM image. The results are shown in Table 2. The XZ phase 5 in the Experiment is mainly the ZrC phase. The phase including Ti and Nb in addition to Zr was included as X. At least one of Zr, Ti and Nb may be included, and a phase including a plural combination thereof or all of them was also included. Also, the phase including N in addition to C was included as Z. At least one kind of C and N may be included, and the phase including both was also included.

Figure 2:
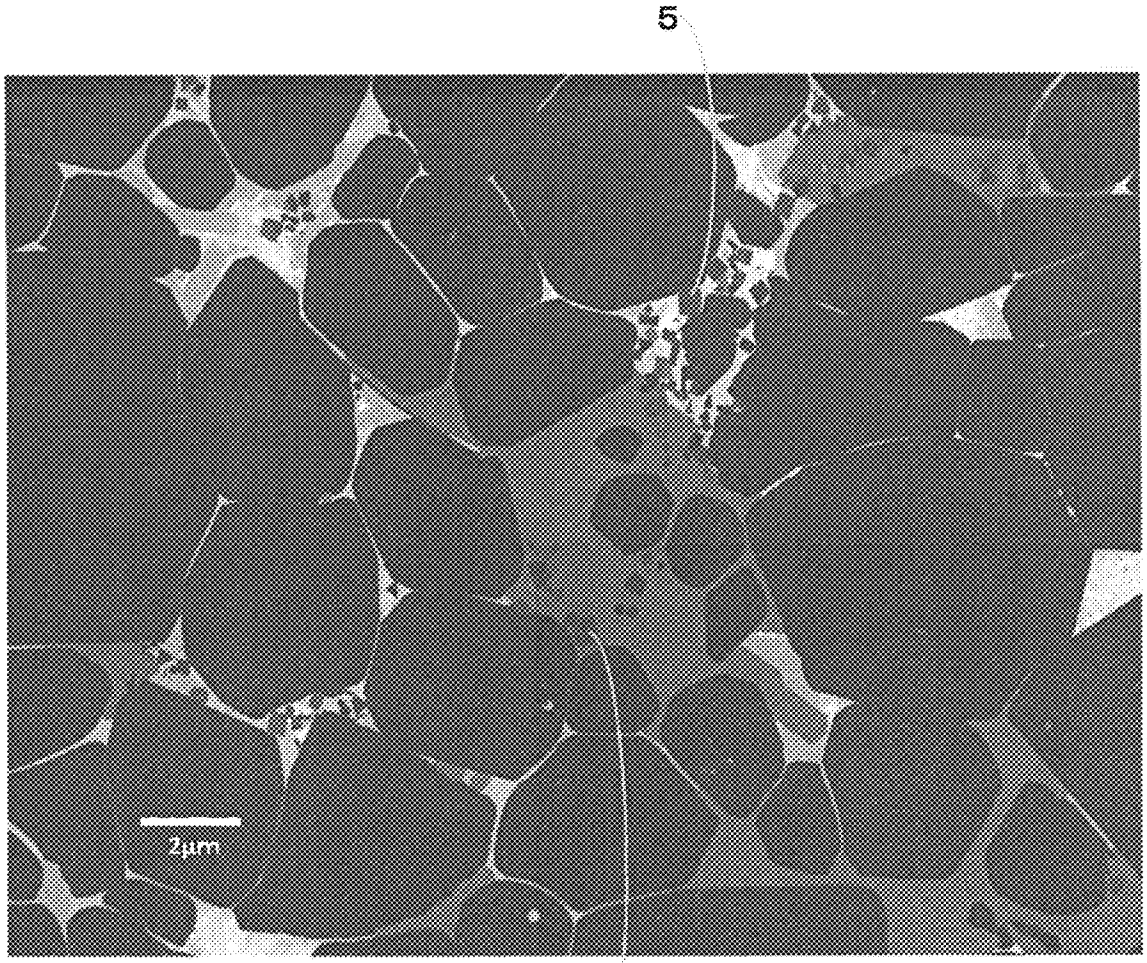
FIG. 2 is a SEM image of one cross section of the R-T-B based permanent magnet of Example 2.
Figure 3:
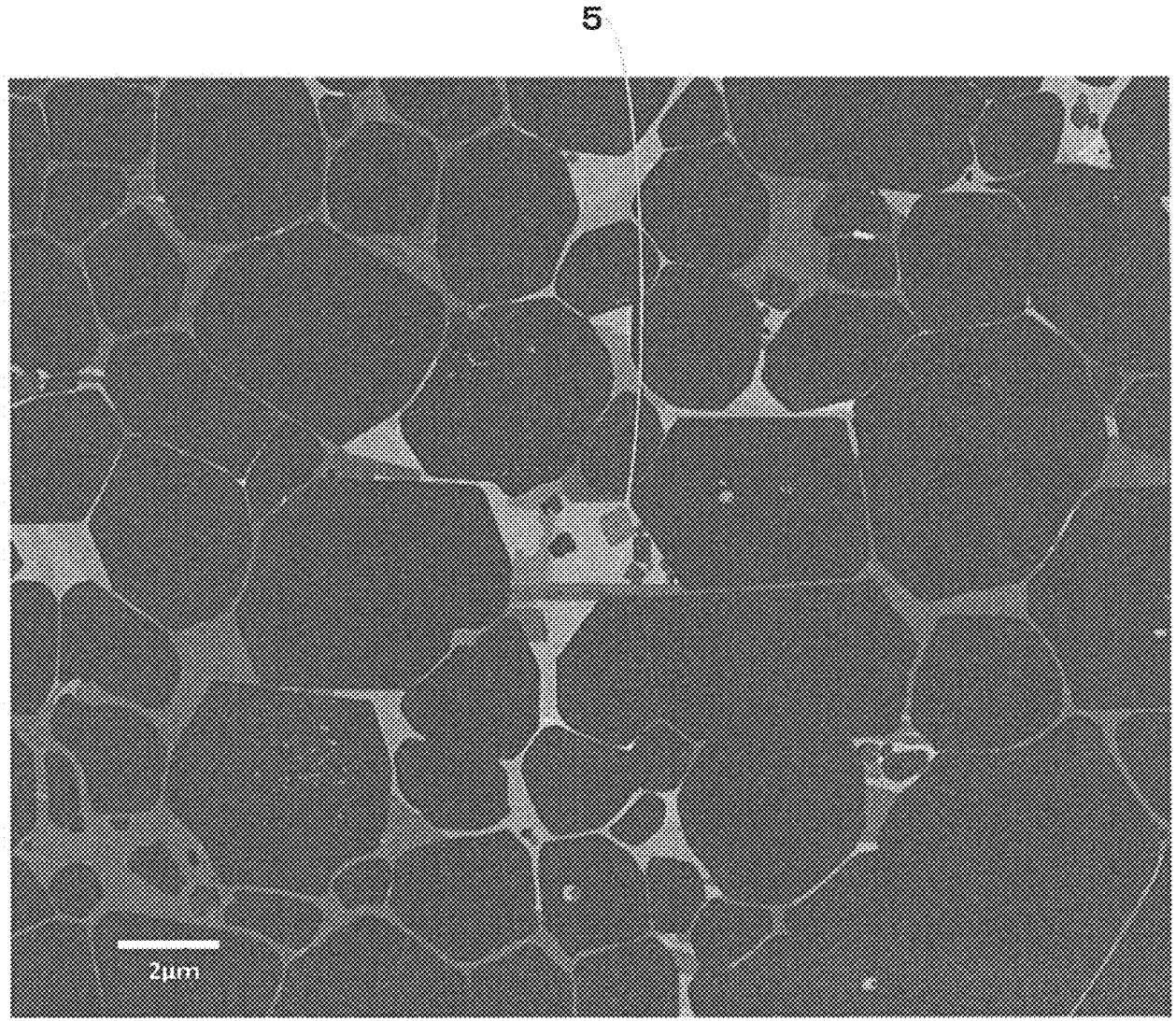
FIG. 3 is a SEM image of one cross section of the R-T-B based permanent magnet of Example 3.

FIG. 2 is the SEM image of Example 2, and FIG. 3 is the SEM image of Example 3. In FIGS. 2 and 3, SEM images in the case where a relatively large XZ phase 5 is present in the grain boundary among Experiment 1 and the below mentioned Experiment 2 are shown. The maximum area thereof is approximately 1 μm$^2$.

Further, the polished cross section of each sample was observed using TEM. TEM images of Example 1 are shown in FIG. 4A and FIG. 4B. FIG. 4B is a drawing in which the boundary between the main phase grains and the grain boundaries in FIG. 4A is clarified. From FIG. 4B, it can be confirmed in Example 1 that the XZ phase 5*a* is present in the grain boundary phase and the XZ phase 5*b* also exists in the main phase grains. In all the examples, it can be confirmed that the XZ phase 5*b* also exists in the main phase grains.

The average composition of the crystal structure phase was measured by EPMA. Ten places were selected from a plurality of EPMA images of the same sample, their compositions were measured, and the average composition thereof was calculated. The results are shown in Table 3.

Furthermore, with respect to the above-mentioned R-T-B based sintered magnet, the electric resistance in the magnet was observed. Specifically, the SSRM mode of SPM was used. AFM5000 and AFM5300E produced by Hitachi High-Tech Sciences Co., Ltd. were used as the apparatus. In the example, a B-doped diamond coated type was used for a probe. When using the SSRM mode, the SIS mode was used to suppress the damage of the probe and to suppress the influence of polishing wastes.

First, an observation sample was prepared by adjusting the size of the sintered magnet. The size of the observation sample was approximately 10 mm square of the observation surface and 5 mm thick.

Next, the surface of the sintered magnet (the surface perpendicular to the magnetic field orientation direction) which becomes the observation surface was mirror polished. Specifically, first, abrasive paper #180, abrasive paper #400, abrasive paper #800 and abrasive paper #1200 were sequentially used and roughly polished in a dry manner. Thereafter, polishing was carried out using a polishing cloth to which diamond abrasive grains having 6 μm diameter were adhered and a DP-Lublicant blue made by Marumoto Struers. Polishing was further carried out using a polishing cloth to which diamond abrasive grains having 0.5 μm diameter were adhered and the above-mentioned DP-Lublicant Blue. Finally, finishing was carried out using a solution of an alcohol, in which $Al_2O_3$ grains of 0.06 μm diameter are dispersed, and a polishing cloth. The observation sample after mirror polished was immediately vacuum packed and taken out to the atmosphere immediately before the observation.

Next, the observation sample was set to a sample holder. According to the example, the observation sample and the sample holder were brought into direct contact with each other so as to electrically connect the observation sample and the sample holder.

Next, the observation surface of the observation sample was observed in the SSRM mode. The observation was done in vacuum. In order to obtain a clear observation image by removing the surface oxide layer, the same place was scanned multiple times. Then, two-dimensional electrical resistance images with different colors depending on the magnitude of the electric resistance were acquired. The bias voltage was measured at 0.1V.

Also, since scanning was performed multiple times, a height difference depending on the hardness of the observation surface occurred. Two-dimensional height difference images with different colors were acquired by the height difference.

With reference to the electric resistance image and the height difference image, the boundary between the main phase grain and the grain boundary was visually determined. Then, a measurement line was set, and a change in electric resistance on the measurement line was observed. In this example, the measurement line was set so that the electric resistance of the crystal structure phase (a crystal phase having $La_6Co_{11}Ga_3$ type crystal structure) can be compared with the electric resistance of the main phase grain with reference to the SEM image.

In the case where the electric resistance in the crystal structure phase is equal to or higher than the electric resistance of the main phase grains, it was confirmed that there is an effect of suppressing the eddy current of the entire sintered magnet, and demagnetization hardly occurs. It is most preferable that the electric resistance in the crystal structure phase exceeds 5 times the electric resistance of the main phase grains. Therefore, according to the Examples in Tables 4 and 9, the case where the electric resistance in the crystal structure phase exceeded five times the electric resistance of the main phase grain is indicated by "Excellent". While the case where the electric resistance in the crystal structure phase was equal to or not more than five times the electric resistance of the main phase grain is indicated by "Good". In Comparative Example 1, no crystal structure phase was present. In Comparative Example 2, the electric resistance in the crystal structure phase was approximately five times and did not exceed five times the electric resistance of the main phase grain. In Example 19 where Al/Ga is high, they were approximately equal.

With respect to the strength (bending strength), a three-point bending test was carried out at n=30 using AG-X made by Shimadzu Corporation in accordance with JIS R1601. The magnet size was 40×10×4 mm. The results are shown in Table 5. Table 5 shows the average value of the bending strength. The bending strength was at least 250 MPa or more, preferably 300 MPa or more, and more preferably 400 MPa or more.

The corrosion resistance test was carried out using a PCT apparatus under conditions of 120° C., 100% RH, and 2 atm. Then, the weight reduction ratio of the sample after the corrosion resistance test with respect to the weight of the sample before the corrosion resistance test was measured. The results are shown in Table 5. The smaller the weight reduction ratio is, the higher the corrosion resistance is.

TABLE 1

| | Compositions of the R-T-B based permanent magnet (at %) | | | | | | | | | | | | | | | |
|---|---|---|---|---|---|---|---|---|---|---|---|---|---|---|---|---|
| | R | | | | B | T | | X | | | M | | | | | |
| | Nd | Pr | Dy | Tb | B | Fe | Co | Zr | Ti | Nb | Ga | Cu | Al | Si | Bi | Sn |
| Ex. 1 | 10.50 | 3.50 | 0.00 | 0.00 | 5.37 | bal. | 2.23 | 0.22 | 0.00 | 0.00 | 0.38 | 0.21 | 0.21 | 0.00 | 0.00 | 0.00 |
| Ex. 2 | 13.42 | 1.68 | 0.00 | 0.00 | 5.15 | bal. | 0.57 | 0.37 | 0.00 | 0.00 | 0.29 | 0.32 | 0.32 | 0.00 | 0.00 | 0.00 |
| Ex. 3 | 13.37 | 0.00 | 0.00 | 0.00 | 4.92 | bal. | 1.11 | 0.14 | 0.00 | 0.00 | 0.56 | 0.21 | 0.21 | 0.00 | 0.00 | 0.00 |
| Ex. 4 | 10.01 | 3.26 | 0.61 | 0.00 | 5.37 | bal. | 2.23 | 0.22 | 0.00 | 0.00 | 0.38 | 0.21 | 0.21 | 0.00 | 0.00 | 0.00 |
| Ex. 5 | 14.54 | 0.00 | 0.00 | 0.42 | 5.14 | bal. | 1.13 | 0.07 | 0.00 | 0.00 | 0.19 | 0.10 | 0.10 | 0.10 | 0.00 | 0.00 |
| Ex. 6 | 13.12 | 2.88 | 0.00 | 0.00 | 5.21 | bal. | 2.29 | 0.37 | 0.00 | 0.00 | 1.36 | 0.53 | 0.53 | 0.00 | 0.00 | 0.00 |
| Ex. 7 | 10.44 | 3.48 | 0.00 | 0.00 | 5.35 | bal. | 2.22 | 0.22 | 0.00 | 0.00 | 0.38 | 0.21 | 0.21 | 0.70 | 0.00 | 0.00 |
| Ex. 9 | 9.00 | 2.50 | 0.00 | 0.00 | 4.50 | bal. | 3.30 | 0.22 | 0.00 | 0.00 | 1.00 | 0.15 | 0.15 | 0.00 | 0.00 | 0.00 |

TABLE 1-continued

| | | | | | | | | | | | | | | | | |
|---|---|---|---|---|---|---|---|---|---|---|---|---|---|---|---|---|
| Ex. 10 | 11.50 | 2.00 | 1.50 | 0.00 | 5.40 | bal. | 3.20 | 0.20 | 0.00 | 0.00 | 2.00 | 0.40 | 0.40 | 0.10 | 0.00 | 0.00 |
| Ex. 12 | 10.50 | 3.50 | 0.00 | 0.00 | 4.75 | bal. | 2.23 | 0.22 | 0.00 | 0.00 | 0.38 | 0.21 | 0.21 | 0.00 | 0.00 | 0.00 |
| Ex. 14 | 10.50 | 3.50 | 0.00 | 0.00 | 5.37 | bal. | 2.23 | 0.22 | 0.00 | 0.00 | 2.50 | 0.80 | 1.00 | 0.30 | 0.20 | 0.20 |
| Comp. Ex. 1 | 10.40 | 3.50 | 0.00 | 0.00 | 6.60 | bal. | 2.21 | 0.21 | 0.00 | 0.00 | 0.37 | 0.20 | 0.48 | 0.00 | 0.00 | 0.00 |
| Comp. Ex. 2 | 10.50 | 3.50 | 0.00 | 0.00 | 5.60 | bal. | 2.26 | 0.22 | 0.00 | 0.00 | 0.24 | 0.20 | 0.20 | 0.00 | 0.00 | 0.00 |
| Comp. Ex. 3 | 10.45 | 3.49 | 0.00 | 0.00 | 5.76 | bal. | 2.22 | 0.22 | 0.00 | 0.00 | 0.38 | 0.21 | 0.21 | 0.00 | 0.00 | 0.00 |
| Comp. Ex. 4 | 10.50 | 3.50 | 0.00 | 0.00 | 5.37 | bal. | 2.23 | 0.00 | 0.00 | 0.00 | 0.38 | 0.21 | 0.21 | 0.00 | 0.00 | 0.00 |

| | Compositions of the R-T-B based permanent magnet (at %) | | | | | XZ | | | |
|---|---|---|---|---|---|---|---|---|---|
| | R in total | M in total | X in total | A1 Pr/Nd | A2 Co/Fe | phase S5(%) | T/R | T/B | R/B |
| Ex. 1 | 14.00 | 0.79 | 0.22 | 0.33 | 0.029 | 0.4 | 5.69 | 14.83 | 2.61 |
| Ex. 2 | 15.10 | 0.92 | 0.37 | 0.13 | 0.007 | 0.4 | 5.20 | 15.24 | 2.93 |
| Ex. 3 | 13.37 | 0.97 | 0.14 | 0.00 | 0.014 | 0.2 | 6.03 | 16.38 | 2.72 |
| Ex. 4 | 13.89 | 0.79 | 0.22 | 0.33 | 0.029 | 0.3 | 5.74 | 14.85 | 2.59 |
| Ex. 5 | 14.96 | 0.50 | 0.07 | 0.00 | 0.014 | 0.2 | 5.30 | 15.43 | 2.91 |
| Ex. 6 | 16.00 | 2.42 | 0.37 | 0.22 | 0.031 | 0.2 | 4.75 | 14.59 | 3.07 |
| Ex. 7 | 13.92 | 1.49 | 0.22 | 0.33 | 0.029 | 0.4 | 5.68 | 14.77 | 2.60 |
| Ex. 9 | 11.50 | 1.30 | 0.22 | 0.28 | 0.042 | 0.2 | 7.17 | 18.33 | 2.56 |
| Ex. 10 | 15.00 | 2.90 | 0.20 | 0.17 | 0.044 | 0.3 | 5.10 | 14.17 | 2.78 |
| Ex. 12 | 14.00 | 0.79 | 0.22 | 0.33 | 0.029 | 0.5 | 5.73 | 16.89 | 2.95 |
| Ex. 14 | 14.00 | 5.00 | 0.22 | 0.33 | 0.030 | 0.3 | 5.39 | 14.04 | 2.61 |
| Comp. Ex. 1 | 13.90 | 1.06 | 0.21 | 0.34 | 0.029 | 0.0 | 5.63 | 11.85 | 2.11 |
| Comp. Ex. 2 | 14.00 | 0.64 | 0.22 | 0.33 | 0.029 | 0.0 | 5.68 | 14.20 | 2.50 |
| Comp. Ex. 3 | 13.94 | 0.79 | 0.22 | 0.33 | 0.029 | 0.0 | 5.69 | 13.77 | 2.42 |
| Comp. Ex. 4 | 14.00 | 0.79 | 0.00 | 0.33 | 0.029 | 0.0 | 5.70 | 14.87 | 2.61 |

TABLE 2

| | Alloy solutionizing treatment | | Sintering conditions | | Aging treatment conditions: The first aging conditions | | Aging treatment conditions: The second aging conditions | | |
|---|---|---|---|---|---|---|---|---|---|
| | Treatment temperature (° C.) | Treatment time (h) | Sintering temperature (° C.) | Sintering time (h) | Aging temperature (° C.) | Aging time (h) | Aging temperature (° C.) | Aging time (h) | Cooling rate (° C./min.) |
| Ex. 1 | 800 | 72 | 1050 | 8 | 800 | 2 | 530 | 2 | 10 |
| Ex. 2 | 800 | 168 | 1050 | 8 | 800 | 2 | 530 | 2 | 10 |
| Ex. 3 | 800 | 168 | 1050 | 8 | 800 | 2 | 530 | 2 | 10 |
| Ex. 4 | 800 | 168 | 1050 | 8 | 800 | 2 | 530 | 2 | 10 |
| Ex. 5 | 800 | 240 | 1040 | 8 | 800 | 2 | 530 | 2 | 40 |
| Ex. 6 | 800 | 240 | 1030 | 8 | 800 | 2 | 530 | 2 | 40 |
| Ex. 7 | 800 | 168 | 1050 | 8 | 800 | 2 | 530 | 2 | 10 |
| Ex. 9 | 800 | 240 | 1070 | 4 | 900 | 1 | 530 | 2 | 40 |
| Ex. 10 | 800 | 240 | 1030 | 8 | 850 | 1 | 510 | 2 | 80 |
| Ex. 12 | 800 | 168 | 1050 | 8 | 850 | 2 | 530 | 2 | 80 |
| Ex. 14 | 800 | 168 | 1040 | 8 | 800 | 2 | 530 | 2 | 10 |
| Comp. Ex. 1 | No treatment | — | 1060 | 8 | 800 | 2 | 530 | 2 | 10 |
| Comp. Ex. 2 | 800 | 24 | 1090 | 2 | 800 | 1 | 490 | 6 | 40 |
| Comp. Ex. 3 | 800 | 168 | 1050 | 8 | 800 | 2 | 530 | 2 | 10 |
| Comp. Ex. 4 | 800 | 168 | 1030 | 12 | 800 | 2 | 530 | 2 | 10 |

| | Br (mT) | HcJ (kA/m) | Sintering temperature range (° C.) | Crystal structure phase S1(%) | R-rich phase S2(%) | R-O-C-N phase S3(%) | Body-centered cubic lattice phase S4(%) | XZ phase S5(%) |
|---|---|---|---|---|---|---|---|---|
| Ex. 1 | 1424 | 1355 | 35 | 4.4 | 0.6 | 3.0 | 2.5 | 0.4 |
| Ex. 2 | 1382 | 1551 | 30 | 5.2 | 1.4 | 2.2 | 3.9 | 0.4 |
| Ex. 3 | 1434 | 1488 | 30 | 6.6 | 1.0 | 2.5 | 4.4 | 0.2 |
| Ex. 4 | 1402 | 1627 | 30 | 4.2 | 0.6 | 2.8 | 2.4 | 0.3 |
| Ex. 5 | 1406 | 1884 | 25 | 3.3 | 1.1 | 2.7 | 1.8 | 0.2 |
| Ex. 6 | 1373 | 1602 | 20 | 7.4 | 2.4 | 2.8 | 3.9 | 0.2 |
| Ex. 7 | 1410 | 1399 | 30 | 4.3 | 0.8 | 2.8 | 2.6 | 0.4 |
| Ex. 9 | 1478 | 1199 | 30 | 7.9 | 2.5 | 2.3 | 3.8 | 0.2 |
| Ex. 10 | 1356 | 1598 | 30 | 5.8 | 3.4 | 2.0 | 4.9 | 0.3 |
| Ex. 12 | 1430 | 1379 | 40 | 4.0 | 0.8 | 2.3 | 1.9 | 0.5 |
| Ex. 14 | 1397 | 1405 | 30 | 5.0 | 0.6 | 2.8 | 3.1 | 0.3 |
| Comp. Ex. 1 | 1405 | 1213 | 10 | 0.0 | 3.4 | 3.4 | 0.0 | 0.0 |
| Comp. Ex. 2 | 1431 | 1276 | 15 | 3.1 | 2.0 | 3.4 | 0.9 | 0.0 |
| Comp. Ex. 3 | 1427 | 1251 | 10 | 5.9 | 0.3 | 3.1 | 2.4 | 0.0 |
| Comp. Ex. 4 | 1427 | 1277 | 10 | 4.0 | 0.8 | 2.7 | 2.3 | 0.0 |

TABLE 3

| | Average compositions (at %) of the crystal structure phase | | | | | | | | | | | | | | | |
|---|---|---|---|---|---|---|---|---|---|---|---|---|---|---|---|---|
| | R | | | | B | T | | X | | | M | | | | | |
| | Nd | Pr | Dy | Tb | B | Fe | Co | Zr | Ti | Nb | Ga | Cu | Al | Si | Bi | Sn |
| Ex. 1 | 20.74 | 8.42 | 0.00 | 0.00 | 0.18 | bal. | 1.94 | 0.02 | 0.00 | 0.00 | 4.60 | 0.34 | 1.26 | 0.00 | 0.00 | 0.00 |
| Ex. 2 | 25.95 | 3.93 | 0.00 | 0.00 | 0.08 | bal. | 0.60 | 0.02 | 0.00 | 0.00 | 4.36 | 0.20 | 1.50 | 0.00 | 0.00 | 0.00 |
| Ex. 3 | 29.40 | 0.00 | 0.00 | 0.00 | 0.06 | bal. | 1.00 | 0.01 | 0.00 | 0.00 | 4.80 | 0.30 | 1.24 | 0.00 | 0.00 | 0.00 |
| Ex. 4 | 22.81 | 5.98 | 0.15 | 0.00 | 0.08 | bal. | 1.90 | 0.02 | 0.00 | 0.00 | 4.75 | 0.26 | 1.03 | 0.00 | 0.00 | 0.00 |
| Ex. 5 | 28.87 | 0.00 | 0.00 | 0.10 | 0.15 | bal. | 1.15 | 0.02 | 0.00 | 0.00 | 4.08 | 0.35 | 1.33 | 0.14 | 0.00 | 0.00 |
| Ex. 6 | 22.13 | 5.99 | 0.00 | 0.00 | 0.01 | bal. | 2.06 | 0.01 | 0.00 | 0.00 | 5.67 | 0.44 | 1.77 | 0.00 | 0.00 | 0.00 |
| Ex. 7 | 22.40 | 8.11 | 0.00 | 0.00 | 0.08 | bal. | 1.96 | 0.01 | 0.00 | 0.00 | 4.28 | 0.26 | 0.92 | 0.90 | 0.00 | 0.00 |
| Ex. 9 | 23.30 | 5.54 | 0.00 | 0.00 | 0.12 | bal. | 2.77 | 0.02 | 0.00 | 0.00 | 4.67 | 0.34 | 1.24 | 0.00 | 0.00 | 0.00 |
| Ex. 10 | 21.32 | 4.04 | 0.00 | 2.20 | 0.09 | bal. | 2.57 | 0.02 | 0.00 | 0.00 | 4.45 | 0.33 | 1.21 | 0.15 | 0.00 | 0.00 |
| Ex. 12 | 20.53 | 8.33 | 0.00 | 0.00 | 0.07 | bal. | 1.75 | 0.02 | 0.00 | 0.00 | 4.60 | 0.34 | 1.22 | 0.00 | 0.00 | 0.00 |
| Ex. 14 | 20.71 | 8.45 | 0.00 | 0.00 | 0.05 | bal. | 1.87 | 0.02 | 0.00 | 0.00 | 4.20 | 0.25 | 1.00 | 0.34 | 0.90 | 0.00 |
| Comp. Ex. 1 | No crystal structure phase | | | | | | | | | | | | | | | |
| Comp. Ex. 2 | 21.54 | 8.46 | 0.00 | 0.00 | 0.03 | bal. | 1.62 | 0.02 | 0.00 | 0.00 | 4.67 | 0.32 | 1.33 | 0.00 | 0.00 | 0.00 |
| Comp. Ex. 3 | 21.00 | 8.00 | 0.00 | 0.00 | 0.04 | bal. | 1.86 | 0.02 | 0.00 | 0.00 | 4.48 | 0.34 | 1.20 | 0.00 | 0.00 | 0.00 |
| Comp. Ex. 4 | 20.77 | 8.48 | 0.00 | 0.00 | 0.03 | bal. | 1.83 | 0.00 | 0.00 | 0.00 | 4.74 | 0.27 | 1.09 | 0.00 | 0.00 | 0.00 |

| | Average compositions (at %) of the crystal structure phase | | | | | | | |
|---|---|---|---|---|---|---|---|---|
| | R in total | M in total | B1 Pr/Nd | B2 Co/Fe | B1/A1 | B2/A2 | Al/Ga | Cu/Ga |
| Ex. 1 | 29.16 | 6.20 | 0.406 | 0.031 | 1.220 | 1.078 | 0.273 | 0.074 |
| Ex. 2 | 29.88 | 6.05 | 0.151 | 0.009 | 1.209 | 1.302 | 0.344 | 0.045 |
| Ex. 3 | 29.40 | 6.34 | 0.000 | 0.016 | | 1.134 | 0.258 | 0.063 |
| Ex. 4 | 28.95 | 6.04 | 0.262 | 0.030 | 0.805 | 1.049 | 0.217 | 0.054 |
| Ex. 5 | 28.97 | 5.90 | 0.000 | 0.018 | | 1.247 | 0.326 | 0.086 |
| Ex. 6 | 28.12 | 7.88 | 0.271 | 0.033 | 1.233 | 1.071 | 0.312 | 0.078 |
| Ex. 7 | 30.52 | 6.36 | 0.362 | 0.032 | 1.085 | 1.109 | 0.215 | 0.061 |
| Ex. 9 | 28.84 | 6.25 | 0.238 | 0.045 | 0.856 | 1.072 | 0.266 | 0.073 |
| Ex. 10 | 27.56 | 6.14 | 0.189 | 0.040 | 1.090 | 0.925 | 0.272 | 0.074 |
| Ex. 12 | 28.86 | 6.16 | 0.406 | 0.028 | 1.218 | 0.970 | 0.265 | 0.074 |
| Ex. 14 | 29.16 | 6.69 | 0.408 | 0.030 | 1.225 | 0.987 | 0.238 | 0.060 |
| Comp. Ex. 1 | No crystal structure phase | | | | | | | |
| Comp. Ex. 2 | 30.00 | 6.32 | 0.393 | 0.026 | 1.178 | 0.893 | 0.285 | 0.069 |
| Comp. Ex. 3 | 29.00 | 6.02 | 0.381 | 0.029 | 1.141 | 1.022 | 0.268 | 0.076 |
| Comp. Ex. 4 | 29.25 | 6.10 | 0.408 | 0.029 | 1.226 | 1.015 | 0.230 | 0.057 |

TABLE 4

| | B content (at %) in the R-T-B based permanent magnet | Alloy solutionizing treatment | Electric resistance in crystal structure phase with respect to Electric resistance of main phase grains |
|---|---|---|---|
| Ex. 1 | 5.37 | Done | Excellent |
| Ex. 2 | 5.15 | Done | Excellent |
| Ex. 3 | 4.92 | Done | Excellent |
| Ex. 4 | 5.37 | Done | Excellent |
| Ex. 5 | 5.14 | Done | Excellent |
| Ex. 6 | 5.21 | Done | Excellent |
| Ex. 7 | 5.35 | Done | Excellent |
| Ex. 9 | 4.50 | Done | Excellent |

TABLE 4-continued

| | B content (at %) in the R-T-B based permanent magnet | Alloy solutionizing treatment | Electric resistance in crystal structure phase with respect to Electric resistance of main phase grains |
|---|---|---|---|
| Ex. 10 | 5.40 | Done | Excellent |
| Ex. 12 | 4.75 | Done | Excellent |
| Ex. 14 | 5.37 | Done | Excellent |
| Comp. Ex. 1 | 6.60 | Not Done | No crystal structure phase |
| Comp. Ex. 2 | 5.60 | Done | Good |

TABLE 5

| | Compositions (at %) of the R-T-B based permanent magnet | | | | | | | | | | | | | | | |
|---|---|---|---|---|---|---|---|---|---|---|---|---|---|---|---|---|
| | R | | | | B | T | | X | | | M | | | | | |
| | Nd | Pr | Dy | Tb | B | Fe | Co | Zr | Ti | Nb | Ga | Cu | Al | Si | Bi | Sn |
| Ex. 1 | 10.50 | 3.50 | 0.00 | 0.00 | 5.37 | bal. | 2.23 | 0.22 | 0.00 | 0.00 | 0.38 | 0.21 | 0.21 | 0.00 | 0.00 | 0.00 |
| Ex. 2 | 13.42 | 1.68 | 0.00 | 0.00 | 5.15 | bal. | 0.57 | 0.37 | 0.00 | 0.00 | 0.29 | 0.32 | 0.32 | 0.00 | 0.00 | 0.00 |
| Ex. 3 | 13.37 | 0.00 | 0.00 | 0.00 | 4.92 | bal. | 1.11 | 0.14 | 0.00 | 0.00 | 0.56 | 0.21 | 0.21 | 0.00 | 0.00 | 0.00 |
| Ex. 4 | 10.01 | 3.26 | 0.61 | 0.00 | 5.37 | bal. | 2.23 | 0.22 | 0.00 | 0.00 | 0.38 | 0.21 | 0.21 | 0.00 | 0.00 | 0.00 |
| Ex. 5 | 14.54 | 0.00 | 0.00 | 0.42 | 5.14 | bal. | 1.13 | 0.07 | 0.00 | 0.00 | 0.19 | 0.10 | 0.10 | 0.10 | 0.00 | 0.00 |
| Ex. 6 | 13.12 | 2.88 | 0.00 | 0.00 | 5.21 | bal. | 2.29 | 0.37 | 0.00 | 0.00 | 1.36 | 0.53 | 0.53 | 0.00 | 0.00 | 0.00 |
| Ex. 7 | 10.44 | 3.48 | 0.00 | 0.00 | 5.35 | bal. | 2.22 | 0.22 | 0.00 | 0.00 | 0.38 | 0.21 | 0.21 | 0.70 | 0.00 | 0.00 |
| Ex. 9 | 9.00 | 2.50 | 0.00 | 0.00 | 4.50 | bal. | 3.30 | 0.22 | 0.00 | 0.00 | 1.00 | 0.15 | 0.15 | 0.00 | 0.00 | 0.00 |

TABLE 5-continued

| | | | | | | | | | | | | | | | | |
|---|---|---|---|---|---|---|---|---|---|---|---|---|---|---|---|---|
| Ex. 10 | 11.50 | 2.00 | 1.50 | 0.00 | 5.40 | bal. | 3.20 | 0.20 | 0.00 | 0.00 | 2.00 | 0.40 | 0.40 | 0.10 | 0.00 | 0.00 |
| Ex. 12 | 10.50 | 3.50 | 0.00 | 0.00 | 4.75 | bal. | 2.23 | 0.22 | 0.00 | 0.00 | 0.38 | 0.21 | 0.21 | 0.00 | 0.00 | 0.00 |
| Ex. 14 | 10.50 | 3.50 | 0.00 | 0.00 | 5.37 | bal. | 2.23 | 0.22 | 0.00 | 0.00 | 2.50 | 0.80 | 1.00 | 0.30 | 0.20 | 0.20 |
| Comp. Ex. 1 | 10.40 | 3.50 | 0.00 | 0.00 | 6.60 | bal. | 2.21 | 0.21 | 0.00 | 0.00 | 0.37 | 0.20 | 0.48 | 0.00 | 0.00 | 0.00 |
| Comp. Ex. 2 | 10.50 | 3.50 | 0.00 | 0.00 | 5.60 | bal. | 2.26 | 0.22 | 0.00 | 0.00 | 0.24 | 0.20 | 0.20 | 0.00 | 0.00 | 0.00 |

| | Compositions (at %) of the R-T-B based permanent magnet | | | | | XZ | | | | Bending | Corrosion resistance:weight reduction |
|---|---|---|---|---|---|---|---|---|---|---|---|
| | R in total | M in total | X in total | A1 Pr/Nd | A2 Co/Fe | phase S5(%) | T/R | T/B | R/B | strength (MPa) | ratio 500 h(mg/cm2) |
| Ex. 1 | 14.00 | 0.79 | 0.22 | 0.33 | 0.029 | 0.4 | 5.69 | 14.83 | 2.61 | 421 | 1.7 |
| Ex. 2 | 15.10 | 0.92 | 0.37 | 0.13 | 0.007 | 0.4 | 5.20 | 15.24 | 2.93 | 356 | 2.4 |
| Ex. 3 | 13.37 | 0.97 | 0.14 | 0.00 | 0.014 | 0.2 | 6.03 | 16.38 | 2.72 | 377 | 1.2 |
| Ex. 4 | 13.89 | 0.79 | 0.22 | 0.33 | 0.029 | 0.3 | 5.74 | 14.85 | 2.59 | 392 | 2.3 |
| Ex. 5 | 14.96 | 0.50 | 0.07 | 0.00 | 0.014 | 0.2 | 5.30 | 15.43 | 2.91 | 366 | 1.4 |
| Ex. 6 | 16.00 | 2.42 | 0.37 | 0.22 | 0.031 | 0.2 | 4.75 | 14.59 | 3.07 | 299 | 3.6 |
| Ex. 7 | 13.92 | 1.49 | 0.22 | 0.33 | 0.029 | 0.4 | 5.68 | 14.77 | 2.60 | 359 | 1.4 |
| Ex. 9 | 11.50 | 1.30 | 0.22 | 0.28 | 0.042 | 0.2 | 7.17 | 18.33 | 2.56 | 288 | 0.8 |
| Ex. 10 | 15.00 | 2.90 | 0.20 | 0.17 | 0.044 | 0.3 | 5.10 | 14.17 | 2.78 | 322 | 1.3 |
| Ex. 12 | 14.00 | 0.79 | 0.22 | 0.33 | 0.029 | 0.5 | 5.73 | 16.89 | 2.95 | 411 | 1.6 |
| Ex. 14 | 14.00 | 5.00 | 0.22 | 0.33 | 0.030 | 0.3 | 5.39 | 14.04 | 2.61 | 336 | 1.5 |
| Comp. Ex. 1 | 13.90 | 1.06 | 0.21 | 0.34 | 0.029 | 0.0 | 5.63 | 11.85 | 2.11 | 264 | 3.8 |
| Comp. Ex. 2 | 14.00 | 0.64 | 0.22 | 0.33 | 0.029 | 0.0 | 5.68 | 14.20 | 2.50 | 297 | 2.1 |

Figure 5:
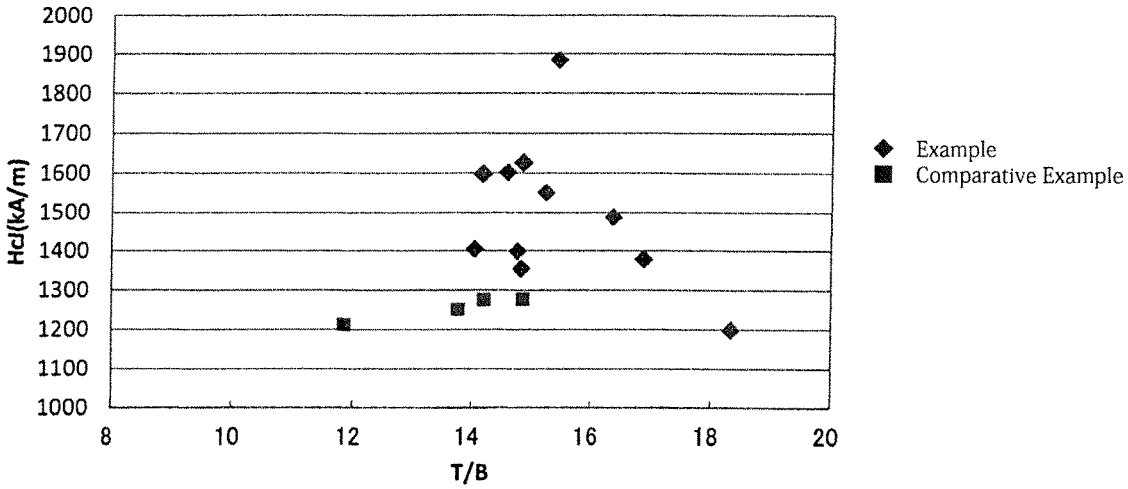
FIG. 5 is a graph showing the relationship between T/B and HcJ in Experiment 1.

Further, FIG. 5 shows a graph comparing T/B and HcJ for each Example (including the XZ phase) and Comparative Example (not including the XZ phase) in Experiment 1.

From Tables 1 to 5, HcJ in each Example including the ZrC phase as the XZ phase was superior to HcJ in each Comparative Example not including the XZ phase. While, when HcJ thereof were approximately equal, Br thereof were excellent.

The XZ phase was not generated in Comparative Examples 1 to 3 because the B content was too large. In Comparative Example 4, since the composition does not include an element corresponding to X, the XZ phase naturally did not generate.

Further, FIG. 5 shows that HcJ tends to be lower as T/B gets higher. While, the HcJ of each Example including the XZ phase is higher than the same of each Comparative Example if the Example and the Comparative Example showed approximately equivalent of T/B.

(Experiment 2)

In Experiment 1, each Example and Comparative Example were produced by mainly changing the compositions and contents of R and B. In Experiment 2, as shown in Table 6, each Example was produced by making compositions of R and B approximately the same and changing the other compositions and the like, and the similar test as in Experiment 1 was carried out. However, in Example 19, an example was produced by a so-called two-alloy method using a main phase alloy not including Al and a grain boundary alloy including Al, instead of carrying out the alloy homogenizing treatment. The results are shown in Tables 6 to 10.

TABLE 6

| | Compositions of the R-T-B based permanent magnet (at %) | | | | | | | | | | | | | | | |
|---|---|---|---|---|---|---|---|---|---|---|---|---|---|---|---|---|
| | R | | | | B | T | | X | | | M | | | | | |
| | Nd | Pr | Dy | Tb | B | Fe | Co | Zr | Ti | Nb | Ga | Cu | Al | Si | Bi | Sn |
| Ex. 1 | 10.50 | 3.50 | 0.00 | 0.00 | 5.37 | bal. | 2.23 | 0.22 | 0.00 | 0.00 | 0.38 | 0.21 | 0.21 | 0.00 | 0.00 | 0.00 |
| Ex. 13 | 10.50 | 3.50 | 0.00 | 0.00 | 5.37 | bal. | 2.23 | 0.22 | 0.00 | 0.00 | 0.20 | 0.10 | 0.10 | 0.10 | 0.00 | 0.00 |
| Ex. 15 | 10.50 | 3.50 | 0.00 | 0.00 | 5.37 | bal. | 2.23 | 0.22 | 0.00 | 0.00 | 0.38 | 0.21 | 0.21 | 0.00 | 0.15 | 0.00 |
| Ex. 16 | 10.50 | 3.50 | 0.00 | 0.00 | 5.37 | bal. | 2.23 | 0.22 | 0.00 | 0.00 | 0.38 | 0.21 | 0.21 | 0.00 | 0.00 | 0.10 |
| Ex. 17 | 10.50 | 3.50 | 0.00 | 0.00 | 5.37 | bal | 0.00 | 0.22 | 0.00 | 0.00 | 0.38 | 0.21 | 0.21 | 0.00 | 0.00 | 0.00 |
| Ex. 18 | 10.50 | 3.50 | 0.00 | 0.00 | 5.37 | bal. | 5.00 | 0.22 | 0.00 | 0.00 | 0.38 | 0.21 | 0.21 | 0.00 | 0.00 | 0.00 |
| Ex. 19 | 10.50 | 3.50 | 0.00 | 0.00 | 5.37 | bal. | 2.23 | 0.11 | 0.11 | 0.00 | 0.33 | 0.21 | 0.35 | 0.00 | 0.00 | 0.00 |
| Ex. 20 | 10.50 | 3.50 | 0.00 | 0.00 | 5.37 | bal. | 2.23 | 0.40 | 0.00 | 0.00 | 0.38 | 0.21 | 0.21 | 0.00 | 0.00 | 0.00 |
| Ex. 21 | 10.50 | 3.50 | 0.00 | 0.00 | 5.37 | bal. | 2.23 | 0.00 | 0.22 | 0.00 | 0.38 | 0.21 | 0.21 | 0.00 | 0.00 | 0.00 |
| Ex. 23 | 10.50 | 3.50 | 0.00 | 0.00 | 5.37 | bal. | 2.23 | 0.00 | 0.00 | 0.22 | 0.38 | 0.21 | 0.21 | 0.00 | 0.00 | 0.00 |
| Ex. 24 | 10.50 | 3.50 | 0.00 | 0.00 | 5.37 | bal. | 2.23 | 0.11 | 0.11 | 0.00 | 0.38 | 0.21 | 0.21 | 0.00 | 0.00 | 0.00 |
| Comp. Ex. 4 | 10.50 | 3.50 | 0.00 | 0.00 | 5.37 | bal. | 2.23 | 0.00 | 0.00 | 0.00 | 0.38 | 0.21 | 0.21 | 0.00 | 0.00 | 0.00 |

| | Compositions of the R-T-B based permanent magnet (at %) | | | XZ | | | | | |
|---|---|---|---|---|---|---|---|---|---|
| | R in total | M in total | X in total | A1 Pr/Nd | A2 Co/Fe | phase S5(%) | T/R | T/B | R/B |
| Ex. 1 | 14.00 | 0.79 | 0.22 | 0.33 | 0.029 | 0.4 | 5.69 | 14.83 | 2.61 |
| Ex. 13 | 14.00 | 0.50 | 0.22 | 0.33 | 0.029 | 0.3 | 5.71 | 14.88 | 2.61 |
| Ex. 15 | 14.00 | 0.94 | 0.22 | 0.33 | 0.029 | 0.4 | 5.68 | 14.80 | 2.61 |
| Ex. 16 | 14.00 | 0.89 | 0.22 | 0.33 | 0.029 | 0.4 | 5.68 | 14.81 | 2.61 |

TABLE 6-continued

| | | | | | | | | | |
|---|---|---|---|---|---|---|---|---|---|
| Ex. 17 | 14.00 | 0.79 | 0.22 | 0.33 | 0.000 | 0.4 | 5.69 | 14.83 | 2.61 |
| Ex. 18 | 14.00 | 0.79 | 0.22 | 0.33 | 0.067 | 0.4 | 5.69 | 14.83 | 2.61 |
| Ex. 19 | 14.00 | 0.89 | 0.22 | 0.33 | 0.029 | 0.2 | 5.68 | 14.81 | 2.61 |
| Ex. 20 | 14.00 | 0.79 | 0.40 | 0.33 | 0.029 | 0.6 | 5.68 | 14.79 | 2.61 |
| Ex. 21 | 14.00 | 0.79 | 0.22 | 0.33 | 0.029 | 0.3 | 5.69 | 14.83 | 2.61 |
| Ex. 23 | 14.00 | 0.79 | 0.22 | 0.33 | 0.029 | 0.2 | 5.69 | 14.83 | 2.61 |
| Ex. 24 | 14.00 | 0.79 | 0.22 | 0.33 | 0.029 | 0.4 | 5.69 | 14.83 | 2.61 |
| Comp. Ex. 4 | 14.00 | 0.79 | 0.00 | 0.33 | 0.029 | 0.0 | 5.70 | 14.87 | 2.61 |

TABLE 7

| | | | | | Aging treatment conditions | | | | |
|---|---|---|---|---|---|---|---|---|---|
| | Alloy solutionizing treatment | | Sintering conditions | | The first aging conditions | | The second aging conditions | | |
| | Treatment temperature (° C.) | Treatment time (h) | Sintering temperature (° C.) | Sintering time (h) | Aging temperature (° C.) | Aging time (h) | Aging temperature (° C.) | Aging time (h) | Cooling rate (° C./min.) |
| Ex. 1 | 800 | 72 | 1050 | 8 | 800 | 2 | 530 | 2 | 10 |
| Ex. 13 | 800 | 168 | 1050 | 8 | 800 | 2 | 530 | 2 | 10 |
| Ex. 15 | 800 | 168 | 1050 | 8 | 800 | 2 | 530 | 2 | 10 |
| Ex. 16 | 800 | 168 | 1050 | 8 | 800 | 2 | 530 | 2 | 10 |
| Ex. 17 | 800 | 168 | 1050 | 8 | 800 | 2 | 550 | 1 | 10 |
| Ex. 18 | 800 | 168 | 1050 | 8 | 900 | 2 | 510 | 1 | 10 |
| Ex. 19 | No treatment | — | 1060 | 4 | 800 | 2 | 530 | 2 | 10 |
| Ex. 20 | 800 | 168 | 1065 | 4 | 800 | 2 | 530 | 2 | 10 |
| Ex. 21 | 800 | 72 | 1050 | 8 | 800 | 2 | 530 | 2 | 10 |
| Ex. 23 | 800 | 72 | 1050 | 8 | 800 | 2 | 530 | 2 | 10 |
| Ex. 24 | 800 | 72 | 1050 | 8 | 800 | 2 | 530 | 2 | 10 |
| Comp. Ex. 4 | 800 | 168 | 1030 | 12 | 800 | 2 | 530 | 2 | 10 |

| | Br (mT) | HcJ (kA/m) | Sintering temperature range (° C.) | Crystal structure phase S1(%) | R-rich phase S2(%) | R-O-C-N phase S3(%) | Body-centered cubic lattice phase S4(%) | XZ phase S5(%) |
|---|---|---|---|---|---|---|---|---|
| Ex. 1 | 1424 | 1355 | 35 | 4.4 | 0.6 | 3.0 | 2.5 | 0.4 |
| Ex. 13 | 1454 | 1301 | 30 | 4.2 | 0.9 | 3.3 | 2.6 | 0.3 |
| Ex. 15 | 1420 | 1370 | 30 | 4.2 | 0.8 | 2.5 | 2.6 | 0.4 |
| Ex. 16 | 1416 | 1367 | 30 | 4.0 | 1.0 | 3.1 | 2.3 | 0.4 |
| Ex. 17 | 1421 | 1389 | 30 | 4.5 | 0.4 | 2.2 | 2.9 | 0.4 |
| Ex. 18 | 1425 | 1322 | 30 | 4.6 | 0.5 | 2.5 | 3.0 | 0.4 |
| Ex. 19 | 1421 | 1308 | 30 | 4.2 | 2.0 | 3.0 | 3.2 | 0.2 |
| Ex. 20 | 1422 | 1366 | 40 | 4.2 | 0.6 | 2.5 | 2.8 | 0.6 |
| Ex. 21 | 1423 | 1322 | 30 | 4.0 | 1.5 | 2.4 | 2.1 | 0.3 |
| Ex. 23 | 1422 | 1321 | 25 | 4.0 | 1.2 | 3.2 | 1.5 | 0.2 |
| Ex. 24 | 1422 | 1340 | 35 | 4.6 | 1.4 | 2.2 | 1.8 | 0.4 |
| Comp. Ex. 4 | 1427 | 1277 | 10 | 4.0 | 0.8 | 2.7 | 2.3 | 0.0 |

TABLE 8

| | Average composition (at %) of the crystal structure phase | | | | | | | | | | | | | | | |
|---|---|---|---|---|---|---|---|---|---|---|---|---|---|---|---|---|
| | R | | | | B | T | | X | | | M | | | | | |
| | Nd | Pr | Dy | Tb | B | Fe | Co | Zr | Ti | Nb | Ga | Cu | Al | Si | Bi | Sn |
| Ex. 1 | 20.74 | 8.42 | 0.00 | 0.00 | 0.18 | bal. | 1.94 | 0.02 | 0.00 | 0.00 | 4.60 | 0.34 | 1.26 | 0.00 | 0.00 | 0.00 |
| Ex. 13 | 20.64 | 8.55 | 0.00 | 0.00 | 0.09 | bal. | 1.94 | 0.02 | 0.00 | 0.00 | 4.45 | 0.39 | 1.40 | 0.13 | 0.00 | 0.00 |
| Ex. 15 | 20.97 | 8.39 | 0.00 | 0.00 | 0.04 | bal. | 1.73 | 0.02 | 0.00 | 0.00 | 4.30 | 0.30 | 1.12 | 0.00 | 0.80 | 0.00 |
| Ex. 16 | 20.66 | 8.44 | 0.00 | 0.00 | 0.08 | bal. | 1.67 | 0.02 | 0.00 | 0.00 | 4.00 | 0.30 | 1.20 | 0.00 | 0.00 | 0.70 |
| Ex. 17 | 20.68 | 8.53 | 0.00 | 0.00 | 0.04 | bal. | 0.00 | 0.02 | 0.00 | 0.00 | 4.46 | 0.34 | 1.33 | 0.00 | 0.00 | 0.00 |
| Ex. 18 | 20.87 | 8.41 | 0.00 | 0.00 | 0.05 | bal. | 3.89 | 0.02 | 0.00 | 0.00 | 4.84 | 0.28 | 1.06 | 0.00 | 0.00 | 0.00 |
| Ex. 19 | 21.03 | 8.44 | 0.00 | 0.00 | 0.03 | bal. | 1.99 | 0.01 | 0.02 | 0.00 | 3.87 | 0.31 | 1.89 | 0.00 | 0.00 | 0.00 |
| Ex. 20 | 20.84 | 8.44 | 0.00 | 0.00 | 0.05 | bal. | 1.88 | 0.03 | 0.00 | 0.00 | 4.70 | 0.33 | 1.21 | 0.00 | 0.00 | 0.00 |
| Ex. 21 | 20.80 | 8.30 | 0.00 | 0.00 | 0.06 | bal. | 1.80 | 0.00 | 0.02 | 0.00 | 4.67 | 0.30 | 1.25 | 0.00 | 0.00 | 0.00 |
| Ex. 23 | 20.97 | 8.28 | 0.00 | 0.00 | 0.10 | bal. | 1.76 | 0.00 | 0.00 | 0.02 | 4.58 | 0.30 | 1.20 | 0.00 | 0.00 | 0.00 |
| Ex. 24 | 20.55 | 8.52 | 0.00 | 0.00 | 0.07 | bal. | 1.94 | 0.01 | 0.01 | 0.00 | 4.60 | 0.32 | 1.20 | 0.00 | 0.00 | 0.00 |
| Comp. Ex. 4 | 20.77 | 8.48 | 0.00 | 0.00 | 0.03 | bal. | 1.83 | 0.00 | 0.00 | 0.00 | 4.74 | 0.27 | 1.09 | 0.00 | 0.00 | 0.00 |

TABLE 8-continued

| | Average composition (at %) of the crystal structure phase | | | | | | | |
|---|---|---|---|---|---|---|---|---|
| | R in total | M in total | B1 Pr/Nd | B2 Co/Fe | B1/A1 | B2/A2 | Al/Ga | Cu/Ga |
| Ex. 1 | 29.16 | 6.20 | 0.406 | 0.031 | 1.220 | 0.463 | 0.273 | 0.074 |
| Ex. 13 | 29.19 | 6.37 | 0.414 | 0.031 | 1.244 | 1.084 | 0.315 | 0.088 |
| Ex. 15 | 29.36 | 6.52 | 0.400 | 0.028 | 1.202 | 0.962 | 0.260 | 0.070 |
| Ex. 16 | 29.10 | 6.20 | 0.409 | 0.027 | 1.227 | 0.920 | 0.300 | 0.075 |
| Ex. 17 | 29.21 | 6.13 | 0.412 | 0.000 | 1.239 | | 0.298 | 0.077 |
| Ex. 18 | 29.28 | 6.18 | 0.403 | 0.064 | 1.210 | 0.958 | 0.219 | 0.058 |
| Ex. 19 | 29.47 | 6.07 | 0.401 | 0.032 | 1.226 | 1.015 | 0.488 | 0.080 |
| Ex. 20 | 29.28 | 6.24 | 0.405 | 0.030 | 1.216 | 1.042 | 0.257 | 0.070 |
| Ex. 21 | 29.10 | 6.22 | 0.399 | 0.029 | 1.182 | 1.042 | 0.268 | 0.064 |
| Ex. 23 | 29.25 | 6.08 | 0.395 | 0.028 | 1.242 | 1.047 | 0.262 | 0.066 |
| Ex. 24 | 29.07 | 6.12 | 0.415 | 0.031 | 1.245 | 1.071 | 0.261 | 0.070 |
| Comp. Ex. 4 | 29.25 | 6.10 | 0.408 | 0.029 | 1.178 | 0.893 | 0.230 | 0.057 |

TABLE 9

| | B content (at %) in the R-T-B based permanent magnet | Alloy solutionizing treatment | Electric resistance in crystal structure phase with respect to Electric resistance of main phase grains |
|---|---|---|---|
| Ex. 1 | 5.37 | Done | Excellent |
| Ex. 13 | 5.37 | Done | Excellent |
| Ex. 15 | 5.37 | Done | Excellent |
| Ex. 16 | 5.37 | Done | Excellent |
| Ex. 17 | 5.37 | Done | Excellent |
| Ex. 18 | 5.37 | Done | Excellent |

TABLE 9-continued

| | B content (at %) in the R-T-B based permanent magnet | Alloy solutionizing treatment | Electric resistance in crystal structure phase with respect to Electric resistance of main phase grains |
|---|---|---|---|
| Ex. 19 | 5.37 | Not Done | Good |
| Ex. 20 | 5.37 | Done | Excellent |
| Ex. 21 | 5.37 | Done | Excellent |
| Ex. 23 | 5.37 | Done | Excellent |
| Ex. 24 | 5.37 | Done | Excellent |

TABLE 10

| | Compositions (at %) of the R-T-B based permanent magnet | | | | | | | | | | | | | | | |
|---|---|---|---|---|---|---|---|---|---|---|---|---|---|---|---|---|
| | R | | | | B | T | | X | | | M | | | | | |
| | Nd | Pr | Dy | Tb | B | Fe | Co | Zr | Ti | Nb | Ga | Cu | Al | Si | Bi | Sn |
| Ex. 1 | 10.50 | 3.50 | 0.00 | 0.00 | 5.37 | bal. | 2.23 | 0.22 | 0.00 | 0.00 | 0.38 | 0.21 | 0.21 | 0.00 | 0.00 | 0.00 |
| Ex. 13 | 10.50 | 3.50 | 0.00 | 0.00 | 5.37 | bal. | 2.23 | 0.22 | 0.00 | 0.00 | 0.20 | 0.10 | 0.10 | 0.10 | 0.00 | 0.00 |
| Ex. 15 | 10.50 | 3.50 | 0.00 | 0.00 | 5.37 | bal. | 2.23 | 0.22 | 0.00 | 0.00 | 0.38 | 0.21 | 0.21 | 0.00 | 0.15 | 0.00 |
| Ex. 16 | 10.50 | 3.50 | 0.00 | 0.00 | 5.37 | bal. | 2.23 | 0.22 | 0.00 | 0.00 | 0.38 | 0.21 | 0.21 | 0.00 | 0.00 | 0.10 |
| Ex. 17 | 10.50 | 3.50 | 0.00 | 0.00 | 5.37 | bal. | 0.00 | 0.22 | 0.00 | 0.00 | 0.38 | 0.21 | 0.21 | 0.00 | 0.00 | 0.00 |
| Ex. 18 | 10.50 | 3.50 | 0.00 | 0.00 | 5.37 | bal. | 5.00 | 0.22 | 0.00 | 0.00 | 0.38 | 0.21 | 0.21 | 0.00 | 0.00 | 0.00 |
| Ex. 19 | 10.50 | 3.50 | 0.00 | 0.00 | 5.37 | bal. | 2.23 | 0.11 | 0.11 | 0.00 | 0.33 | 0.21 | 0.35 | 0.00 | 0.00 | 0.00 |
| Ex. 20 | 10.50 | 3.50 | 0.00 | 0.00 | 5.37 | bal. | 2.23 | 0.40 | 0.00 | 0.00 | 0.38 | 0.21 | 0.21 | 0.00 | 0.00 | 0.00 |
| Ex. 21 | 10.50 | 3.50 | 0.00 | 0.00 | 5.37 | bal. | 2.23 | 0.00 | 0.22 | 0.00 | 0.38 | 0.21 | 0.21 | 0.00 | 0.00 | 0.00 |
| Ex. 23 | 10.50 | 3.50 | 0.00 | 0.00 | 5.37 | bal. | 2.23 | 0.00 | 0.00 | 0.22 | 0.38 | 0.21 | 0.21 | 0.00 | 0.00 | 0.00 |
| Ex. 24 | 10.50 | 3.50 | 0.00 | 0.00 | 5.37 | bal. | 2.23 | 0.11 | 0.11 | 0.00 | 0.38 | 0.21 | 0.21 | 0.00 | 0.00 | 0.00 |

| | Compositions (at %) of the R-T-B based permanent magnet | | | | | XZ | | | | Bending | Corrosion resistance:weight reduction |
|---|---|---|---|---|---|---|---|---|---|---|---|
| | R in total | M in total | X in total | A1 Pr/Nd | A2 Co/Fe | phase S5(%) | T/R | T/B | R/B | strength (MPa) | ratio 500 h(mg/cm2) |
| Ex. 1 | 14.00 | 0.79 | 0.22 | 0.33 | 0.029 | 0.4 | 5.69 | 14.83 | 2.61 | 421 | 1.7 |
| Ex. 13 | 14.00 | 0.50 | 0.22 | 0.33 | 0.029 | 0.3 | 5.71 | 14.88 | 2.61 | 442 | 1.9 |
| Ex. 15 | 14.00 | 0.94 | 0.22 | 0.33 | 0.029 | 0.4 | 5.68 | 14.80 | 2.61 | 400 | 1.6 |
| Ex. 16 | 14.00 | 0.89 | 0.22 | 0.33 | 0.029 | 0.4 | 5.68 | 14.81 | 2.61 | 404 | 1.6 |
| Ex. 17 | 14.00 | 0.79 | 0.22 | 0.33 | 0.000 | 0.4 | 5.69 | 14.83 | 2.61 | 397 | 10.2 |
| Ex. 18 | 14.00 | 0.79 | 0.22 | 0.33 | 0.067 | 0.4 | 5.69 | 14.83 | 2.61 | 422 | 0.5 |
| Ex. 19 | 14.00 | 0.89 | 0.22 | 0.33 | 0.029 | 0.2 | 5.68 | 14.81 | 2.61 | 362 | 3.2 |
| Ex. 20 | 14.00 | 0.79 | 0.40 | 0.33 | 0.029 | 0.6 | 5.68 | 14.79 | 2.61 | 420 | 1.6 |
| Ex. 21 | 14.00 | 0.79 | 0.22 | 0.33 | 0.029 | 0.3 | 5.69 | 14.83 | 2.61 | 388 | 1.7 |
| Ex. 23 | 14.00 | 0.79 | 0.22 | 0.33 | 0.029 | 0.2 | 5.69 | 14.83 | 2.61 | 402 | 1.7 |
| Ex. 24 | 14.00 | 0.79 | 0.22 | 0.33 | 0.029 | 0.4 | 5.69 | 14.83 | 2.61 | 415 | 1.7 |

Figure 6:
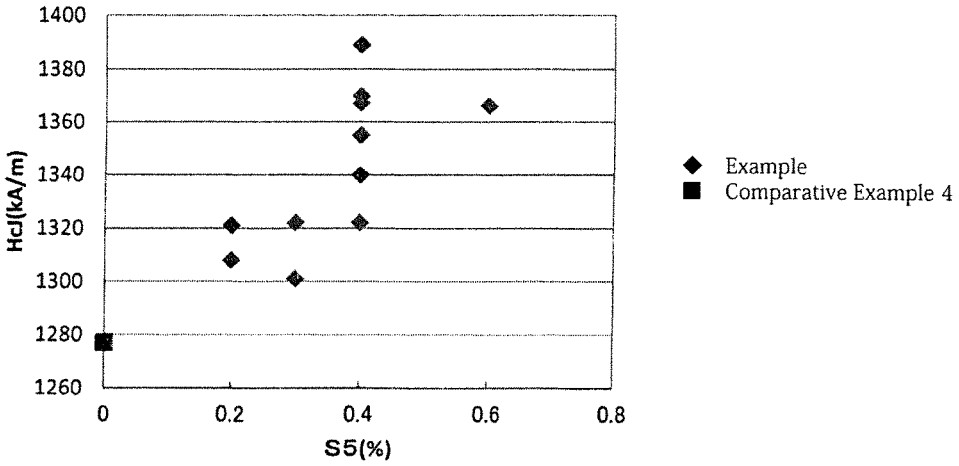
FIG. 6 is a graph showing the relationship between S5 and HcJ in Experiment 2.

Further, FIG. 6 shows a graph comparing the area ratio and HcJ of the XZ phase for each Example and Comparative Example 4 in Experiment 2.

From Tables 6 to 10 and FIG. 6, in each Example including the XZ phase, R and B were almost the same composition, and HcJ was superior as compared with Comparative Example 4 not including the XZ phase.

Further, when comparing Example 1, Example 24 and Example 21 in which only the ratios of Zr and Ti in X were different, Example 1 showed the most preferable test result as a whole.

Furthermore, as the Al/Ga became lower, the weight reduction rate tended to lower, and the corrosion resistance tended to improve.

(Experiment 3)

Examples 31 to 35 were produced in the same manner as in Experiment 1 except that the raw material metals were prepared so that the compositions of the R-T-B based sintered magnets would be the compositions of each sample shown in Table 11 and the test was conducted under the conditions described in Table 12. Example 34 was produced in the same manner as in Example 33 except that the alloy homogenizing treatment was not performed and the raw material alloy not including Zr was coarsely pulverized and then ZrC with D50=5 μm was added and finely pulverized. The results are shown in Table 12.

Among the properties shown in Table 12, regarding the maximum area of the XZ phase, SEM observation was performed on each sample and specified thereof.

From Examples 31 to 34, the size per one XZ phase can be changed by controlling various production conditions. Also, as in Example 35, it can be seen that when the X content is large, the maximum area of the XZ phase becomes large.

From Table 12, it was confirmed that various properties, particularly Br, sintering temperature range and bending strength, are improved as the maximum area of the XZ phase is smaller.

EXPLANATION OF REFERENCES

1 . . . Crystal phase (crystal structure phase) having $La_6Co_{11}Ga_3$ type crystal structure
3 . . . R-O-C-N phase
4 . . . Body-centered cubic lattice phase
5 . . . XZ phase
5*a* . . . XZ phase (in grain boundary phase)
5*b* . . . XZ phase (in main phase)
6 . . . R-rich phase
10 . . . Main phase grain

The invention claimed is:

1. An R-T-B based permanent magnet comprising main phase grains comprising an $R_2T_{14}B$ compound and a grain boundary, wherein R is one or more rare earth elements comprising Nd, T is Fe or Fe and Co, and B is boron, the R-T-B based permanent magnet further comprises X, Z and M,

TABLE 11

| | Compositions of the R-T-B based permanent magnet (at %) | | | | | | | | | | | | | | | | | | |
|---|---|---|---|---|---|---|---|---|---|---|---|---|---|---|---|---|---|---|---|
| | R | | | | B | T | | X | | | M | | | | | | R in | M in | X in |
| | Nd | Pr | Dy | Tb | B | Fe | Co | Zr | Ti | Nb | Ga | Cu | Al | Si | Bi | Sn | total | total | total |
| Ex. 31 | 10.50 | 3.50 | 0.00 | 0.00 | 5.37 | bal. | 2.23 | 0.37 | 0.00 | 0.00 | 0.38 | 0.21 | 0.21 | 0.00 | 0.00 | 0.00 | 14.00 | 0.79 | 0.37 |
| Ex. 32 | 10.50 | 3.50 | 0.00 | 0.00 | 5.37 | bal. | 2.23 | 0.37 | 0.00 | 0.00 | 0.38 | 0.21 | 0.21 | 0.00 | 0.00 | 0.00 | 14.00 | 0.79 | 0.37 |
| Ex. 33 | 10.50 | 3.50 | 0.00 | 0.00 | 5.37 | bal. | 2.23 | 0.37 | 0.00 | 0.00 | 0.38 | 0.21 | 0.21 | 0.00 | 0.00 | 0.00 | 14.00 | 0.79 | 0.37 |
| Ex. 34 | 10.50 | 3.50 | 0.00 | 0.00 | 5.37 | bal. | 2.23 | 0.37 | 0.00 | 0.00 | 0.38 | 0.21 | 0.21 | 0.00 | 0.00 | 0.00 | 14.00 | 0.79 | 0.37 |
| Ex. 35 | 10.50 | 3.50 | 0.00 | 0.00 | 5.37 | bal. | 2.23 | 0.45 | 0.00 | 0.00 | 0.38 | 0.21 | 0.21 | 0.00 | 0.00 | 0.00 | 14.00 | 0.79 | 0.45 |

TABLE 12

| | Alloy solutionizing treatment | | Sintering conditions | | Aging treatment conditions: The first aging conditions | | Aging treatment conditions: The second aging conditions | | | | | Sintering temperature range | | | XZ phase maximum area |
|---|---|---|---|---|---|---|---|---|---|---|---|---|---|---|---|
| | Treatment temperature (° C.) | Treatment time (h) | Sintering temperature (° C.) | Sintering time (h) | Aging temperature (° C.) | Aging time (h) | Aging temperature (° C.) | Aging time (h) | Cooling rate (° C./min.) | Br (mT) | HcJ (kA/m) | (° C.) | XZ phase S5(%) | Bending strength (MPa) | ($\mu m^2$) |
| Ex. 31 | 800 | 240 | 1050 | 16 | 800 | 2 | 530 | 2 | 10 | 1408 | 1382 | 25 | 0.5 | 399 | 1.0 |
| Ex. 32 | 800 | 120 | 1050 | 12 | 800 | 2 | 530 | 2 | 10 | 1417 | 1377 | 30 | 0.5 | 422 | 0.25 |
| Ex. 33 | 800 | 60 | 1050 | 8 | 800 | 2 | 530 | 2 | 10 | 1425 | 1370 | 40 | 0.4 | 432 | 0.04 |
| Ex. 34 | No treatment | | 1050 | 8 | 800 | 2 | 530 | 2 | 10 | 1410 | 1374 | 20 | 0.4 | 386 | 1.0 |
| Ex. 35 | 800 | 240 | 1070 | 4 | 800 | 2 | 530 | 2 | 10 | 1402 | 1308 | 20 | 0.6 | 339 | 12 |

X is one or more selected from the group consisting of Ti, V, Zr, Nb, Hf and Ta, Z is one or more selected from the group consisting of C and N, M comprises Ga and further comprises one or more selected from the group consisting of Al, Si, Ge, Cu, Bi and Sn, and the grain boundary comprises an XZ phase having a face-centered cubic structure, a crystal phase having a $La_6Co_{11}Ga_3$ crystal structure, an R-rich phase, an R-O-C-N phase and a body-centered cubic lattice phase, and $$S1>S2,$$

$$S1>S3,$$

$$S1>S4 \text{ and,}$$

$$S1>S5$$

wherein an area ratio of the crystal phase having a $La_5Co_{11}Ga_3$ crystal structure in a cross-sectional area of the R-T-B based permanent magnet is S1, an area ratio of the R-rich phase is S2, an area ratio of the R-O-C-N phase is S3, an area ratio of the body-centered cubic lattice phase is S4, and an area ratio of the XZ phase is S5, and S1 is 7.9% or less and S3 is 2.0% or more.

2. The R-T-B based permanent magnet according to claim 1, wherein

R content is 13.3 at % or more and 15.5 at % or less,

M content is 0.5 at % or more and 5.0 at % or less,

B content is 4.0 at % or more and 5.5 at % or less,

X content is 0.05 at % or more and 0.5 at % or less, and

T is a substantial balance, with respect to 100 at % of the total contents of the respective elements of R, T, B, M and X, and the R-T-B based permanent magnet further satisfies all the following expressions:

$$4.5<T/R<7.0,$$

$$14<T/B<18 \text{ and}$$

$$2.5<R/B<3.0.$$

3. The R-T-B based permanent magnet according to claim 1, wherein the maximum area of the XZ phase is 16 $\mu m^2$ or less.

4. The R-T-B based permanent magnet according to claim 2, wherein the maximum area of the XZ phase is 16 $\mu m^2$ or less.

5. The R-T-B based permanent magnet according to claim 1, wherein the maximum area of the XZ phase is 12 $\mu m^2$ or less.

6. The R-T-B based permanent magnet according to claim 2, wherein the maximum area of the XZ phase is 12 $\mu m^2$ or less.

7. The R-T-B based permanent magnet according to claim 1, wherein an existence ratio of Zr included in the XZ phase is 50 at % or more with the X being 100 at %, and an existence ratio of C included in the XZ phase is 50 at % or more with the Z being 100 at %.

8. The R-T-B based permanent magnet according to claim 2, wherein an existence ratio of Zr included in the XZ phase is 50 at % or more with the X being 100 at %, and an existence ratio of C included in the XZ phase is 50 at % or more with the Z being 100 at %.

9. The R-T-B based permanent magnet according to claim 1, wherein an area ratio of the XZ phase in a region of a cross-sectional area of the R-T-B based sintered magnet is 0.1 to 2%.

10. The R-T-B based permanent magnet according to claim 2, wherein an area ratio of the XZ phase in a region of a cross-sectional area of the R-T-B based sintered magnet is 0.1 to 2%.

11. The R-T-B based permanent magnet according to claim 1, wherein the crystal phase comprises R, M, B and X, and in the crystal phase, R content is 27.0 at % or more and 32.0 at % or less, M content is 3.0 at % or more and 8.0 at % or less, B content is zero at % or more and 0.40 at % or less, and X content is zero at % or more and 0.45 at % or less.

12. The R-T-B based permanent magnet according to claim 2, wherein the crystal phase comprises R, M, B and X, and in the crystal phase, R content is 27.0 at % or more and 32.0 at % or less, M content is 3.0 at % or more and 8.0 at % or less, B content is zero at % or more and 0.40 at % or less, and X content is zero at % or more and 0.45 at % or less.

* * * * *